US010724232B2

(12) United States Patent
Glavin

(10) Patent No.: US 10,724,232 B2
(45) Date of Patent: Jul. 28, 2020

(54) CONSTRUCTION SYSTEM

(71) Applicant: GLAVLOC BUILD SYSTEMS LIMITED, Cork (IE)

(72) Inventor: Paul Glavin, Midleton (IE)

(73) Assignee: Glavloc Build Systems Limited, Cork (IE)

( * ) Notice: Subject to any disclaimer, the term of this patent is extended or adjusted under 35 U.S.C. 154(b) by 0 days.

(21) Appl. No.: 16/086,542

(22) PCT Filed: Mar. 15, 2017

(86) PCT No.: PCT/EP2017/056154
§ 371 (c)(1),
(2) Date: Sep. 19, 2018

(87) PCT Pub. No.: WO2017/162500
PCT Pub. Date: Sep. 28, 2017

(65) Prior Publication Data

US 2019/0100910 A1 Apr. 4, 2019

(30) Foreign Application Priority Data

Mar. 22, 2016 (EP) ..... 16161667
Jan. 24, 2017 (EP) ..... 17152931

(51) Int. Cl.
*E04B 1/00* (2006.01)
*E04B 2/70* (2006.01)
(Continued)

(52) U.S. Cl.
CPC ..... *E04B 2/707* (2013.01); *E04B 1/26* (2013.01); *E04B 1/6162* (2013.01); *E04B 5/02* (2013.01);
(Continued)

(58) Field of Classification Search
CPC ... E04B 2/707; E04B 1/26; E04B 7/04; E04B 5/02; E04B 1/6162; E04B 7/20;
(Continued)

(56) References Cited

U.S. PATENT DOCUMENTS 1,459,761 A * 6/1923 Andrews ..... E04B 1/26 164/DIG. 4
1,858,715 A * 5/1932 McKay ..... E04B 2/58 52/284
(Continued)

FOREIGN PATENT DOCUMENTS

FR 2736073 A1 1/1997

OTHER PUBLICATIONS

International Preliminary Report on Patentability issued in PCT/EP2017/056154; dated Sep. 25, 2018; 7pp.
(Continued)

*Primary Examiner* — Basil S Katcheves
(74) *Attorney, Agent, or Firm* — Studebaker & Brackett PC

(57) ABSTRACT

A construction system for a wall or floor or roof uses a set of studs having panel engagement features protruding from opposed edges of the stud. Panel elements having apertures receive these features so that they protrude through the panel element apertures. Retainers engage the panel engagement features and press against an outside surface of a panel element and towards the studs with a compression force to form a compression joint. There may be rails to form a mesh with the studs, and the panel elements may not be wide enough to abut each other, narrow panel elements providing sufficient structural strength in combination with the compression joints and the studs.

18 Claims, 24 Drawing Sheets

(51) Int. Cl.

| | |
|---|---|
| ***E04B 1/26*** | (2006.01) |
| ***E04B 1/61*** | (2006.01) |
| ***E04B 5/02*** | (2006.01) |
| ***E04B 7/04*** | (2006.01) |
| ***E04B 7/20*** | (2006.01) |
| ***E04C 2/42*** | (2006.01) |
| *E04C 2/34* | (2006.01) |

(52) U.S. Cl.
CPC ..... *E04B 7/04* (2013.01); *E04B 7/20* (2013.01); *E04C 2/423* (2013.01); *E04B 2001/2624* (2013.01); *E04B 2001/2664* (2013.01); *E04B 2001/2672* (2013.01); *E04C 2002/3488* (2013.01)

(58) Field of Classification Search
CPC ..... E04B 2001/2672; E04B 2001/2664; E04B 2001/2624; E04C 2/423; E04C 2002/3488; E04C 2001/2672
USPC ..... 52/284, 426, 562
See application file for complete search history.

(56) References Cited

U.S. PATENT DOCUMENTS 2,336,435 A * 12/1943 Zirinsky ..... E04B 1/34315 52/236.7
3,206,903 A * 9/1965 Johnson ..... E04B 1/26 52/276
3,566,558 A * 3/1971 Fisher ..... E04B 1/20 52/185
3,902,291 A * 9/1975 Zucht ..... G09B 25/04 52/284
4,461,130 A * 7/1984 Shubow ..... E04B 1/20 52/236.6
4,709,640 A * 12/1987 Jouanin ..... A47B 47/0041 108/181
5,281,181 A * 1/1994 McCollum ..... A63H 33/044 446/106
5,323,584 A * 6/1994 Scarlett ..... E04C 3/14 52/841
5,865,660 A * 2/1999 Smith ..... A63H 33/042 446/106
6,481,172 B1 11/2002 Porter
7,168,766 B2 * 1/2007 Pelletier ..... A47C 3/029 297/440.13
8,281,529 B2 * 10/2012 Cluff ..... E04B 1/26 52/271
8,651,296 B2 * 2/2014 Beaty ..... A47F 5/11 211/135
9,420,879 B1 * 8/2016 Brandenberg ..... A47B 13/088
9,909,604 B1 * 3/2018 Fawcett ..... F16B 12/125
2002/0104280 A1 * 8/2002 Fleishman ..... E04B 1/61 52/284
2002/0178669 A1 * 12/2002 Harambasic ..... E04B 1/04 52/264
2002/0178676 A1 * 12/2002 Yost ..... E04B 2/8635 52/426
2003/0014933 A1 * 1/2003 Worley ..... E04G 11/14 52/426
2003/0192272 A1 * 10/2003 Bravinski ..... E04B 2/8635 52/309.11
2006/0137273 A1 * 6/2006 Baker ..... B28B 7/0011 52/426
2006/0179756 A1 * 8/2006 McGregor ..... E04G 11/062 52/426
2007/0193169 A1 * 8/2007 Emblin ..... E04B 1/161 52/426
2007/0227095 A1 * 10/2007 Hubbe ..... E04B 2/707 52/653.1
2008/0307736 A1 * 12/2008 Trimmer ..... E04G 17/047 52/426
2009/0013629 A1 * 1/2009 Boeshart ..... E04B 2/8617 52/426
2009/0282766 A1 11/2009 Roen
2010/0093257 A1 * 4/2010 Elliott ..... A47B 3/06 446/478
2011/0099932 A1 * 5/2011 Saulce ..... E04B 2/845 52/426
2011/0179736 A1 * 7/2011 Waldron ..... E02B 3/12 52/426
2016/0032581 A1 * 2/2016 Sklar ..... A63H 33/084 52/220.8
2016/0348369 A1 * 12/2016 Godfrey ..... E04C 3/36
2019/0048586 A1 * 2/2019 Kim ..... E04B 7/02

OTHER PUBLICATIONS

International Search Report issued in PCT/EP2017/056154; dated May 10, 2017.
Written Opinion issued in PCT/EP2017/056154; dated May 10, 2017.

* cited by examiner

CONSTRUCTION SYSTEM

FIELD OF THE INVENTION

The invention relates to construction of buildings.

PRIOR ART DISCUSSION

In recent years there have been many developments in construction systems, particularly modular systems. Such modular systems are very advantageous for many projects, because whole units can be manufactured off site to exact standards in an environment which is much more efficient than on site.

However, where the buildings are modest in size and there can be frequent design changes modular construction may not be suitable.

U.S. Pat. No. 6,481,172 (Porter) describes structural wall panels having studs and insulation, and facings of gypsum or the like secured in place by pins or nails.

The invention is directed towards providing a construction system which allows simpler and more versatile construction of buildings either on site or off site. Another objective is to provide a high structural strength in walls while using materials with good thermal insulation properties, with ease of construction either on site or off site, and/or with less use of materials.

SUMMARY OF THE INVENTION

According to the invention, there is provided a construction system for a wall or floor or roof comprising:

- a set of studs having side and edge surfaces, at least one of said set of studs comprising panel engagement features protruding from an edge of the stud,
- panel elements having apertures to receive said features so that the engagement features protrude through the panel element apertures, and
- retainers for engaging said panel engagement features and pressing against an outside surface of a panel element and towards the studs with a compression force to form a compression joint.

In one embodiment, at least one stud comprises a series of a plurality of panel engagement features along at least one edge. In one embodiment, there is a series of panel engagement features on both opposed sides of at least one stud. In one embodiment, at least one panel engagement feature comprises a portion extending distally from the stud edge and a portion extending laterally, and configured so that the retainer fits within a space bordered by said portions with a tight fit so that said compression force is applied.

In one embodiment, each engagement feature comprises an opposed pair of said portions forming a socket therebetween. In one embodiment, the panel engagement features comprise dovetail sockets.

In one embodiment, the retainer is in the form of a tongue configured for engagement with a friction fit with the panel engagement feature. In one embodiment, the retainer is wedge-shaped, with a narrower leading end.

In one embodiment, the system further comprises braces configured to interconnect a plurality of compression joints.

In one embodiment, at least one brace comprises a plurality of arms each configured to engage a compression joint.

In one embodiment, the system further comprises a sole-plate having apertures for receiving ends of the studs and/or a header plate having apertures to receive ends of the studs.

In one embodiment, the sole plate and/or the header plate have apertures and corresponding bridging inserts fitting said apertures, wherein a pair of plates butted at a cut through an aperture may be joined by insertion of said insert across the cut line. In one embodiment, said apertures are shaped to form two opposed dovetail sockets.

In one embodiment, said apertures are configured to form opposed dovetail sockets when cut through at approximately 45° to a longitudinal direction of the plate.

In one embodiment, the system further comprises outer sheets arranged to be fixed to the retainers to form a cavity defined by depth of the retainers.

In one embodiment, at least two panel elements are joined by bridging members each inserted into an aperture formed by opposing recesses on edges of adjoining panel elements to complete a panel. In one embodiment, the recesses have dovetail socket configurations. In one embodiment, the panel elements comprise a series of a plurality of recesses for said joining.

In one embodiment, at least one of said panel elements is configured to form part of a window or door lintel. In one embodiment, at least one of the studs comprises a plurality of layers of wood-based material.

In one embodiment, the system further comprises rails extending across and inter-connecting studs. In one embodiment, the studs are wider than the rails. In one embodiment, the studs are at least 100% wider than the rails. In one embodiment, the studs have inter-engagement features on at least one side edge and the system comprises a set of rails having corresponding inter-engagement features for engaging the stud features to form an inter-meshed grid.

In one embodiment, at least some rails comprise bracing tongues and the panel has slots to receive said bracing tongues. In one embodiment, at least some panels are narrow, not extending to abut adjoining panels.

In one embodiment, the system further comprises a waterproof skin arranged to fit over a panel, the skin having sufficient rigidity to maintain shape of recesses to accommodate the compression joints. In one embodiment, the skin is of aluminium material. In one embodiment, the skin thickness is in the range of 0.2 mm to 0.5 mm. In one embodiment, the skin includes louvres.

In one embodiment, the system further comprises preformed insulation floor lower sections arranged for butting together to form a sub-floor and having features for engaging concrete upper floor sections, and the sections are configured to support a wall formed by a construction system of any preceding claim.

In one embodiment, the lower section features comprise grooves to receive corresponding ridges of the upper sections.

In one embodiment, the system comprises an elongate corner member configured to extend vertically to form a corner at adjoining walls, the corner member comprising a vertical corner portion having a configuration to form a corner and orthogonal tongues extending from the corner portion for butting against two walls. In one embodiment, the tongues extend from a single corner of the corner portion.

In one embodiment, the system comprises an elongate eaves member configured to extend along a joint between a wall and a roof, the eaves member comprising a downwardly-depending portion configured to engage a wall and an upper portion configured to engage a roof.

In one embodiment, the upper portion is configured to provide space for a wall plate to rest on the eaves member so that joists can rest on both the wall plate and the eaves member upper portion. In one embodiment, the eaves member is configured to abut ends of joists resting on a wall and terminating over the wall. In one embodiment, the eaves member upper portion extends at an angle of a roof pitch to engage the roof.

We also describe an elongate eaves member configured to extend along a joint between a wall and a roof, the eaves member comprising a downwardly-depending portion configured to engage a wall and an upper portion configured to engage a roof.

The upper portion may be configured to provide space for a wall plate to rest on the eaves member so that joists can rest on both the wall plate and the eaves member upper portion.

The eaves member may be configured to abut ends of joists resting on a wall and terminating over the wall.

The eaves member upper portion may extend at an angle of a roof pitch to engage the roof.

The invention also provides a building whenever constructed using a construction system and/or an eaves member of any embodiment.

We also describe a construction method performed with a system of any embodiment, the method comprising fabricating a structural wall section by aligning the studs parallel to each other, applying a panel element so that the engagement features protrude through the panel apertures, and engaging the retainers with the panel engagement features with a friction fit so that they press against an outside surface of the panel and towards the studs with a compression force to form a compression joint.

In one embodiment, a panel is applied on both opposed sides of the studs. In one embodiment, the retainers are tapped into engagement with a friction fit.

The method may include mounting at least one brace behind a plurality of retainers so that the brace links the compression joints.

The method may include a further step of engaging ends of the studs in apertures of a sole plate and a wall plate.

The method may include a further step of connecting at least two panel elements alongside edges by inserting bridging inserts into opposed sockets along the panel element side edges.

The method may include a further step of applying an outer sheet by fixing the sheet to retainers so that there is a gap between the sheet and the panel elements set by depth of the retainers.

The method may include a further step of applying a waterproof membrane to the outside surface of a panel element, the membrane having recesses to accommodate the compression joints.

Additional Statements

According to the invention, there is provided a construction system for a wall or floor or roof comprising:

a set of studs; and panels secured to the studs, and optionally:

the studs have inter-engagement features on at least one side edge and the system comprises a set of rails having corresponding inter-engagement features for engaging the stud features to form an inter-meshed grid.

The rails may or may not be required for the structural strength required. If not present, bracing strength may be provided partly or wholly by panels secured on one or both sides of the studs.

In one embodiment, the stud and/or the rail inter-engagement features include slots.

In one embodiment, at least one of the studs and rails comprises a plurality of layers of wood-based material.

In one embodiment, the studs are wider than the rails.

In one embodiment, the studs are at least 100% wider than the rails.

In one embodiment, at least one of said set of studs and/or rails comprises panel engagement features protruding from an edge, and the system comprises panels having apertures to receive said features.

In one embodiment, at least one of said sets of studs and/or rails comprises panel engagement features protruding from opposed side edges.

In one embodiment, the panel engagement features comprise dovetail sockets.

In one embodiment, the system panels have apertures arranged so that the panel engagement feature protrude through the panel apertures.

In one embodiment, the system comprises retainers for engaging said panel engagement features and pressing against an outside surface of a panel in a compression joint.

In one embodiment, rails comprise bracing tongues and the panel has slots to receive said bracing tongues.

In one embodiment, the system further comprises a sole-plate having apertures for receiving ends of the studs.

In one embodiment, the system further comprises a header plate having apertures to receive ends of the studs.

In one embodiment, the sole plate and/or the header plate have apertures and corresponding inserts fitting said apertures, wherein a pair of plates butted at a cut through an aperture may be joined by insertion of said insert across the cut line.

In one embodiment, said apertures are of general shape forming two opposed dovetail sockets, with two corners facing longitudinally, and two corners facing transversely.

In one embodiment, the system further comprises outer panels arranged to be fixed to the retainers to form a cavity defined by depth of the retainers.

In one embodiment, the system further comprises preformed insulation floor lower sections arranged for butting together to form a sub-floor and having features for engaging concrete upper floor sections, and the sections are configured to support a wall formed by a construction system of any preceding claim.

In one embodiment, the lower section features comprise grooves to receive corresponding ridges of the upper sections.

In one embodiment, at least two panels are joined by bridging members each inserted into an aperture formed by opposing recesses on edges of adjoining panels.

In one embodiment, the recesses have dovetail socket configurations.

In one embodiment, at least one of said panels forms part of a window or door lintel.

In one embodiment, the system comprises two walls adjoining at a corner and a vertical corner member having a configuration to form a corner external surface and orthogonal tongues for butting against the two walls.

In one embodiment, the system comprises a wall and a roof, and an elongate eaves member extending along a joint between the wall and the roof, adjoining the wall on one side and adjoining the roof on another side.

In one embodiment, the eaves member abuts ends of joists resting on the wall and terminating over the wall.

In one embodiment, the roof comprises a structural wall portion along rafters or between rafters and adjoining the eaves member.

In another aspect, the invention provides an eaves member of elongate shape and configured to extend along a joint between a wall and a roof, adjoining the wall on one side and adjoining the roof on another side.

In one embodiment, the eaves member is configured to abuts ends of joists resting on the wall and terminating over the wall.

In another aspect, the invention provides a building whenever constructed using a construction system and/or an eaves member of any embodiment.

According to the invention, there is provided a construction system for a wall or floor comprising:

a set of studs having inter-engagement features on at least one side edge; and a set of rails having corresponding inter-engagement features for engaging the stud features to form an inter-meshed grid.

In one embodiment, the stud and/or the rail inter-engagement features include slots.

In one embodiment, at least one of the studs and rails comprises a plurality of layers of wood-based material. In one embodiment, the studs are wider than the rails. In one embodiment, the studs are at least 100% wider than the rails.

In one embodiment, at least one of said set of studs and rails comprises panel engagement features protruding from an edge, and the system comprises panels having apertures to receive said features.

In one embodiment, at least one of said sets of studs and rails comprises panel engagement features protruding from opposed side edges. In one embodiment, the panel engagement features comprise dovetail sockets.

In one embodiment, the system panels have apertures arranged so that the panel fits over a grid formed by the studs and rails with the panel engagement feature protruding through the panel apertures. In one embodiment, the system comprises retainers for engaging said panel engagement features and pressing against an outside surface of a panel in a compression joint. In one embodiment, rails comprise bracing tongues and the panel has slots to receive said bracing tongues.

In one embodiment, the system further comprises a soleplate having apertures for receiving ends of the studs.

In one embodiment, the system further comprises a header plate having apertures to receive ends of the studs.

In one embodiment, the sole plate and/or the header plate have apertures and corresponding inserts fitting said apertures, wherein a pair of plates butted at a cut through an aperture may be joined by insertion of said insert across the cut line. In one embodiment, said apertures are of general diamond slope, with two corners facing longitudinally, and two corners facing transversely.

In one embodiment, the system further comprises outer panels arranged to be fixed to the retainers to form a cavity defined by depth of the retainers.

In one embodiment, the system further comprises preformed insulation floor lower sections arranged for butting together to form a sub-floor and having features for engaging concrete upper floor sections, and the sections are configured to support a wall formed by a construction system of any preceding claim.

In one embodiment, the lower section features comprise grooves to receive corresponding ridges of the upper sections.

In another aspect, the invention provides a building whenever constructed by a construction system of any embodiment.

The invention also provides a method of constructing a building, the method including forming grids by intermeshing the studs and rails of any embodiment, placing panels against the grids so that the panel fasteners protrude through the panel apertures, and inserting retainers into the panel fasteners so that they press against outside surfaces of the panels.

DETAILED DESCRIPTION OF THE INVENTION

BRIEF DESCRIPTION OF THE DRAWINGS

The invention will be more clearly understood from the following description of some embodiments thereof, given by way of example only with reference to the accompanying drawings in which.

DESCRIPTION OF THE EMBODIMENTS

Figure 1:
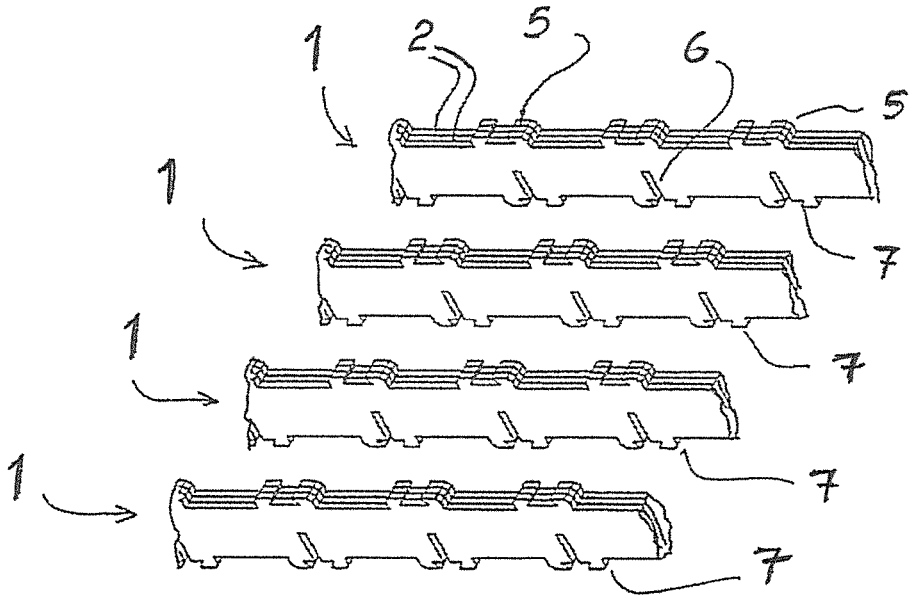
FIGS. 1 to 7 are a sequence of perspective views illustrating manufacture of a wall using a construction system of the invention.
Figure 2:
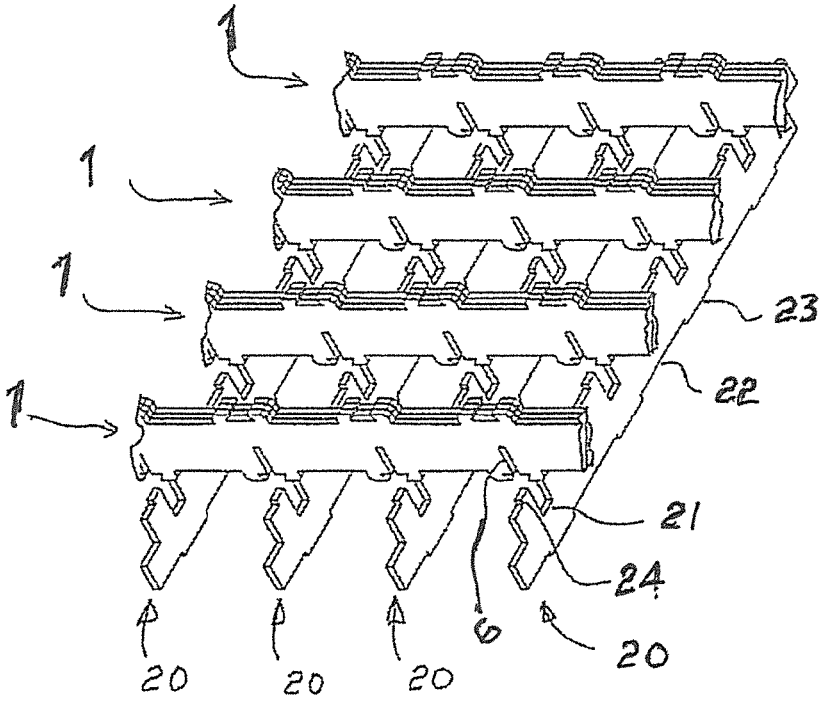
Figure 3:
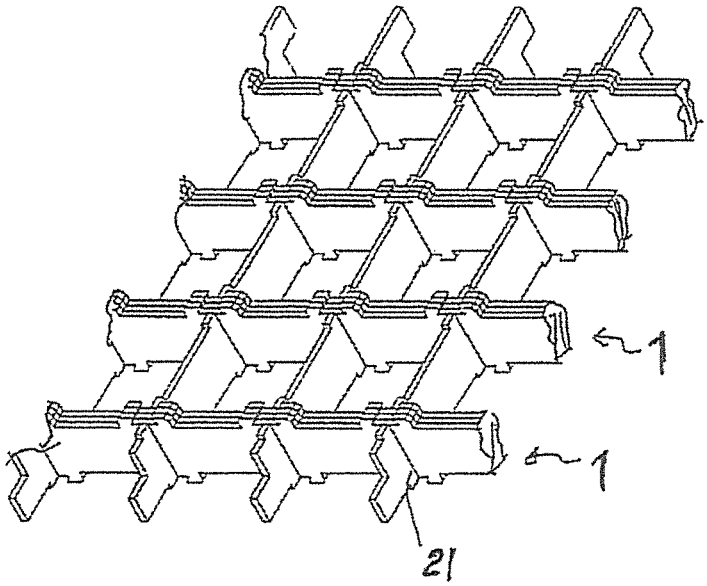
Figure 4:
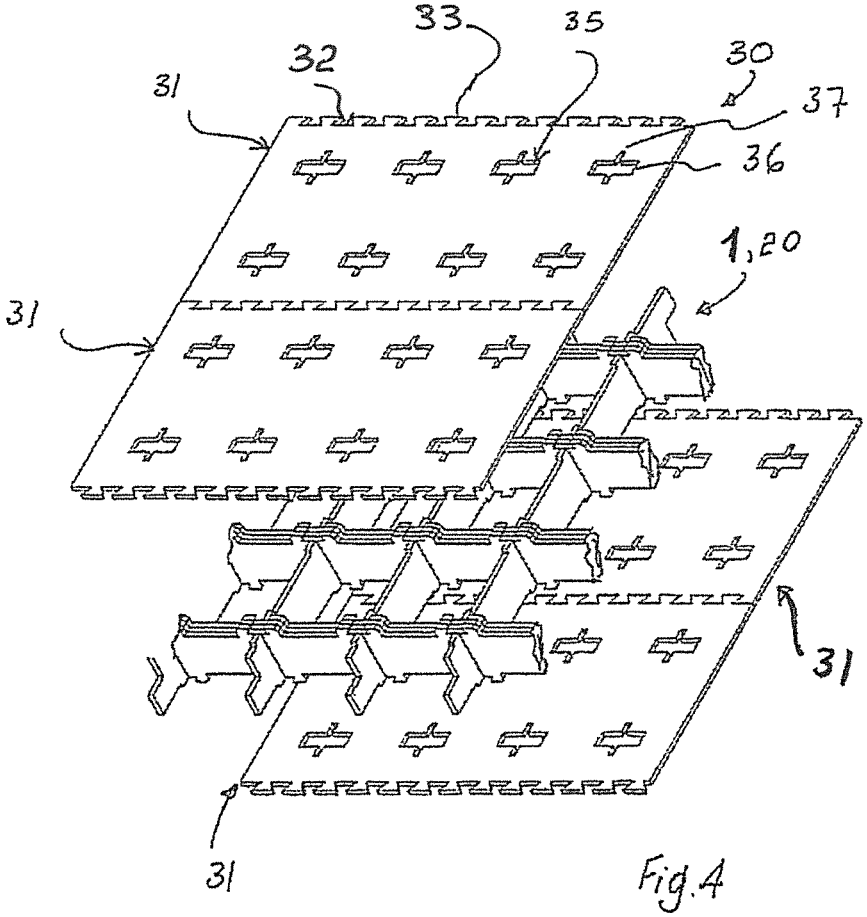

Referring to FIGS. 1 to 7 a construction system of the invention includes a limited number of standard components for constructing a wall and/or ceiling, and/or a floor. In this specification the term "wall" will be used, however the wall sections or elements manufactured according to the invention may alternatively be used in a floor, a ceiling, or a roof aligned in the rafters direction.

For constructing a wall a desired number of beams, namely studs 1 and rails 20 are cut to length. The studs 1 each comprise of single or multiple layers 2 of composite wood material in a high-strength laminated arrangement. Each stud 1 is pre-cut along a first edge to form dovetail sockets 5, and along its second edge to form orthogonal slits 6 and opposed dovetail sockets 7 directly below. There are preferably a series of panel engagement dovetail sockets 5 along each edge, and preferably the separation of the dovetail sockets 5 is in the range of 500 mm to 750 mm, in one embodiment about 600 mm. Also, it is preferred that there be dovetail sockets 5 and 7 on both opposed edges of the studs. This achieves, as described below, compression joints on both opposed sides of a wall for optimum load resistance.

Each rail 20 is pre-cut along its first edge to form a series of slots 21 matched to the width of the stud 1. Along its second edge each rail 20 has elongate shallow tongues 23 separated by recesses 22.

The various features of the beams are formed in registry so that they can inter-mesh to form a grid of a desired size. As shown particularly in FIGS. 2 and 3 the studs 1 are simply pressed down so that their slits 6 encompass the rails 20 and the slots 21 encompass the studs 1. The studs 1 and the rails 20 therefore form a grid with an inter-locking joint at every corner. The extent of contact between edge faces of the beams ensures that the grid is particularly strong despite the fact that there are no fasteners or adhesives used. The grid forms the structure of a wall or ceiling, or floor. Insulation, if desired, may be placed within some or all of the spaces within the grid. As shown particularly in FIGS. 4 and 5 the grid is then faced on both sides by panels 30 formed from inter-locking panel elements 31. Each compression panel element comprises a series 32 of dovetail sockets and tongues formed alternately along two opposed side edges. Also, within each panel element 31 there is a set of apertures 35 at locations corresponding to intersection points in the grid formed by the studs 1 and the rails 20. Each aperture 35 comprises a rectangular portion 36 and a pair of slots 37 extending from opposed sides of the rectangular portion.

When a compression panel 30 is placed on the first side of the grid the dovetail sockets 5 fit through the apertures 35, with tongues 23 and 24 of the rails 20 fitting into the slots 37 of the apertures 35.

The same is done on the second side of the grid. A compression panel 30 is placed so that the second dovetail sockets 7 and tongues 23 fit through the apertures 35.

Figure 5:
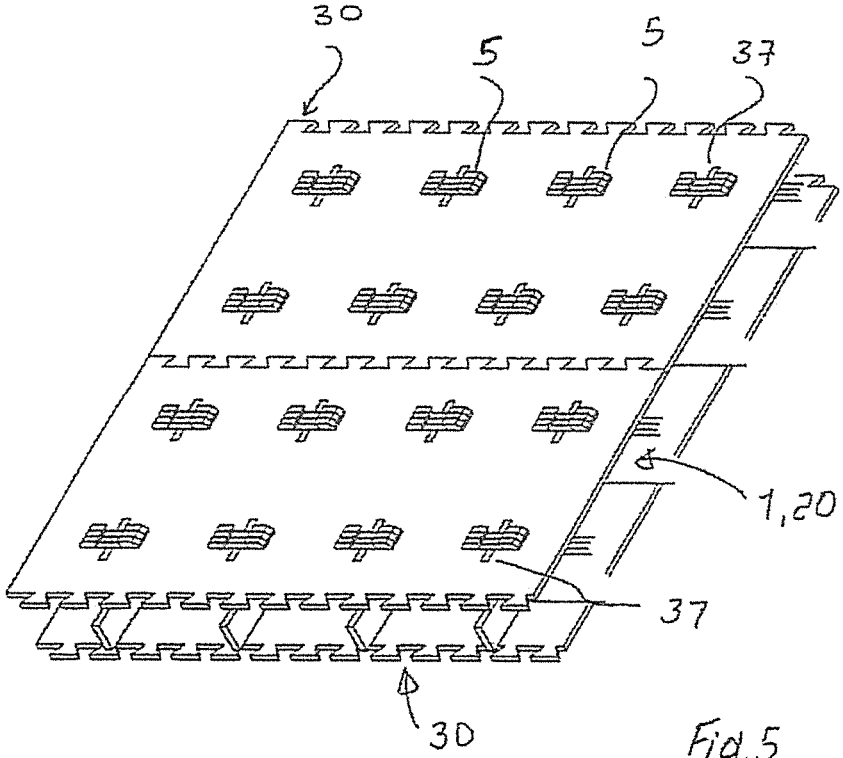

As shown in FIG. 5, the panels 30 form first and second base surfaces of the wall, with the dovetail sockets 5 and 7 of the studs 1 proud of the external surfaces of the panels 30.

Figure 6:
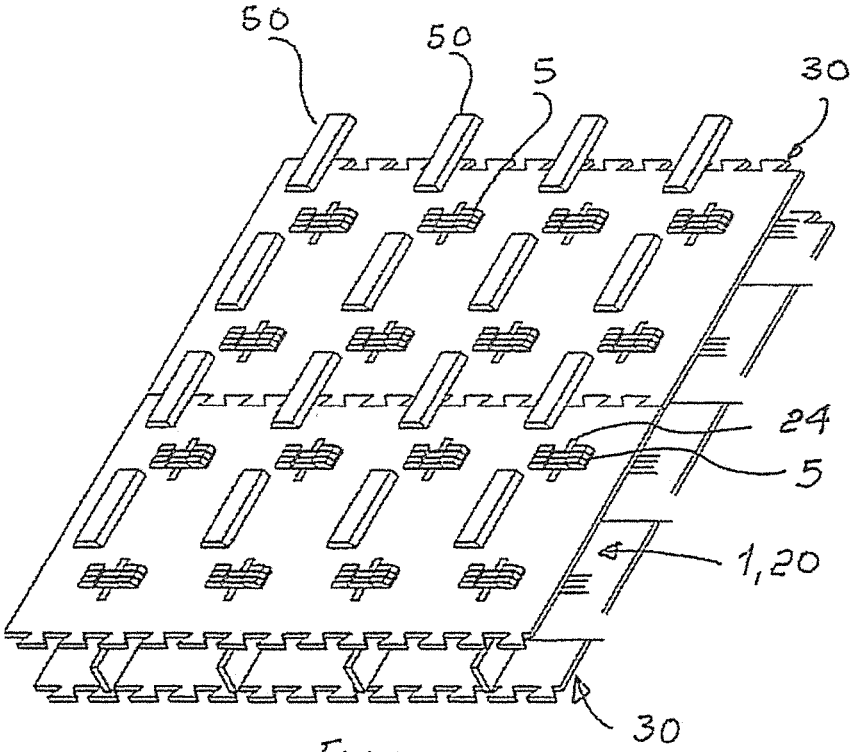
Figure 7:
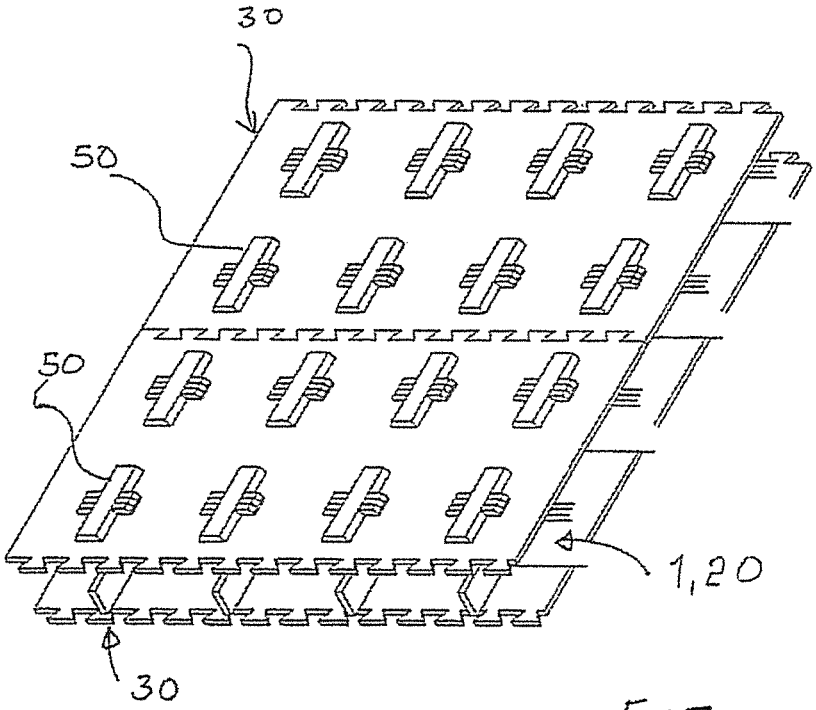

Retainers 50 are inserted into the dovetail sockets 5, aligned parallel with, and pressing against, the exposed surface of the panel 30, as shown in FIGS. 6 and 7. The retainers 50 and the dovetail sockets 5 and 7 form compression joints which press the panels inwardly towards the studs, rails, and insulation. This completes a base structure which may be used for a wall, ceiling, or floor, in which the panels on opposed sides are in compression towards the studs. This achieves excellent structural strength. The retainers 50 have the shape for a friction fit within the dovetail sockets 5 and 7, so that there is compression force against the external surface of the panel element 31.

Each retainer 50 may in one embodiment be tapered slightly to have a wedge shape with an increasing thickness from its leading edge, to facilitate easy insertion and to ensure good compression arising from the wedge effect. Any such taper is small, for example 1 to 2 mm over a length of 150 to 200 mm. Also, the retainer may have a shoulder or other protrusion about mid-way along its length to prevent insertion beyond that position.

Preferably, plasterboard is applied over the retainers 50, providing a thin cavity having the depth of the retainers. The retainers 50 provide a convenient external surface for nailing of plasterboard or other sheet of material, the depth of the retainers 50 providing an insulation cavity. Any desired further layers may be applied according to the location of the wall and the building design. For example external insulation slabs may be applied, followed by a cladding providing an external surface.

The system components may be manufactured by for example milling with a CNC machine from engineered timber sheets if the numbers are small, or moulded from composite materials for higher volume production.

Figure 8:
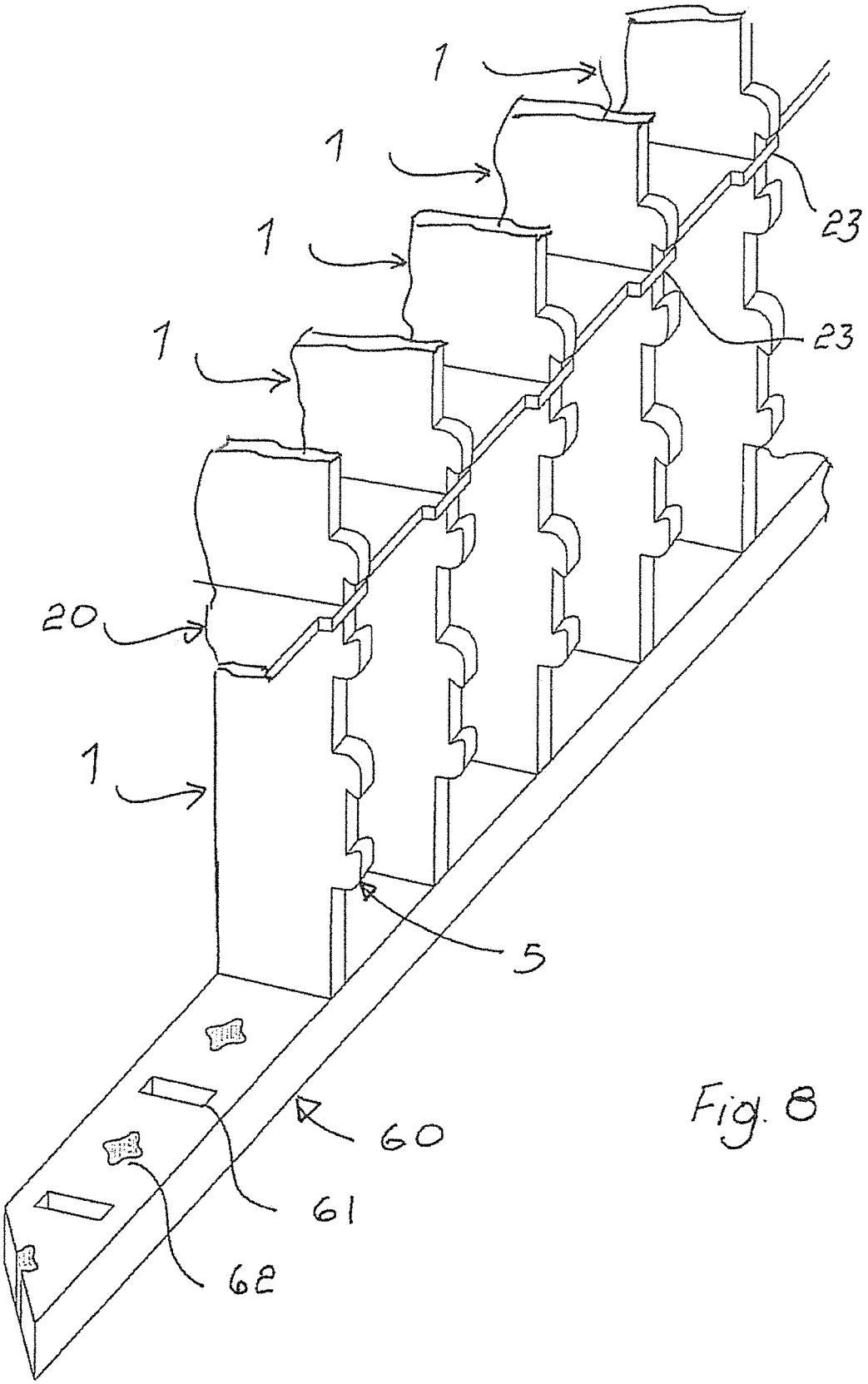
FIG. 8 is a perspective view of part of a wall, showing interconnection of studs and a rail on a sole plate in more detail.

Referring to FIG. 8 the wall may be built on a soleplate 60, with the studs 1 fitting into apertures 61 of the soleplate. The soleplate also includes apertures 62 having an overall diamond shape, with two opposed corners facing longitudinally and the other two facing transversely. This allows the sole plate to be cut at 45° and butted with another to form a joint in which each side of the aperture 62 acts as a dovetail socket. This is described in more detail below.

Figure 9:
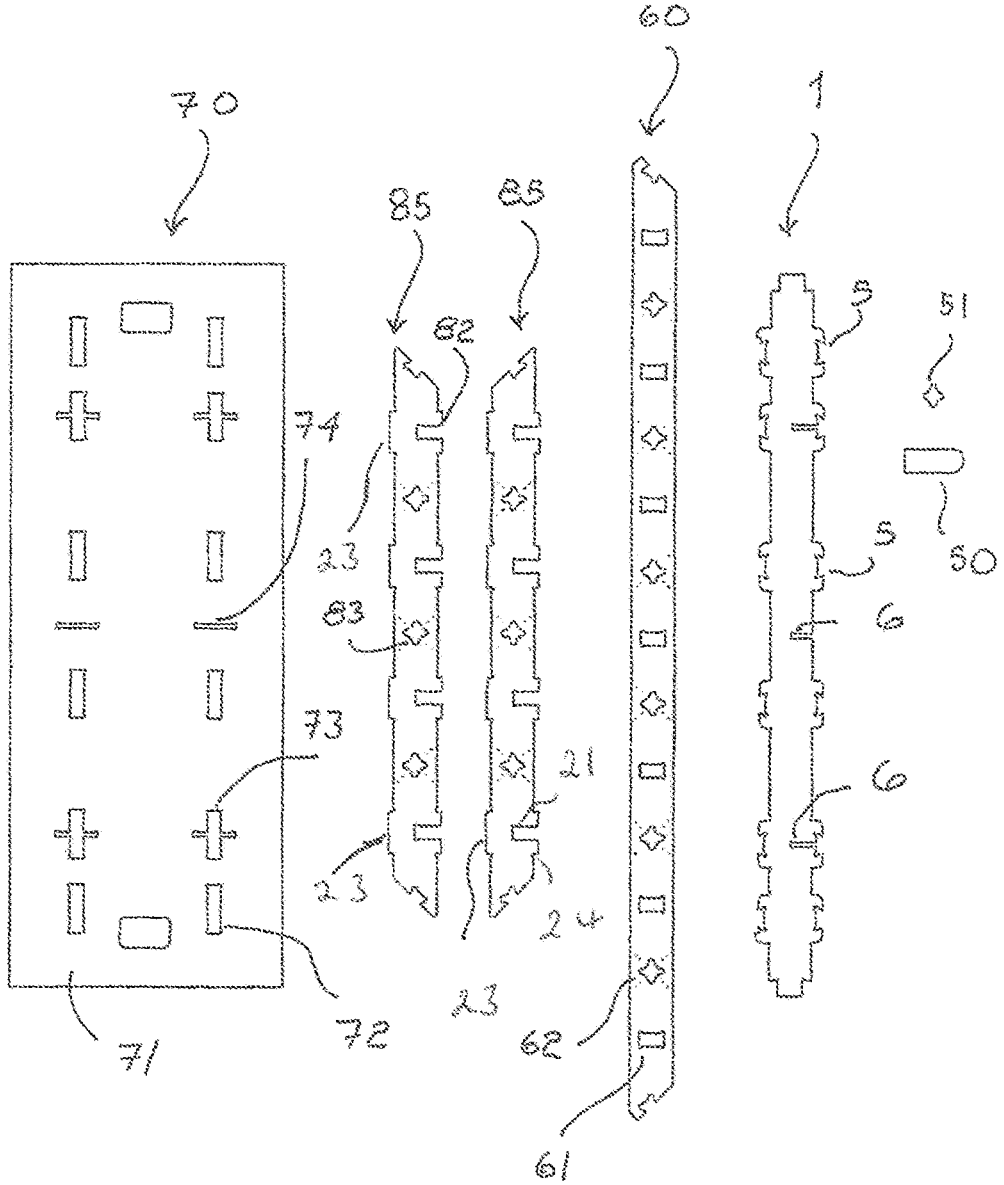
FIG. 9 is a plan view of a set of components for constructing a wall.

Referring to FIG. 9 a complete set of components for wall structure construction in one embodiment is illustrated. There are only approximately 10 to 15 types of structural components in total, which can be used in various combinations to tailor the system to the required end use. This allows the builder to construct a building by bringing these simple components, thereby requiring little transport space and avoiding need to lift heavy weights, and allowing accessibility to locations such as the rear of a terraced house to build an extension. Of course, if desired wall elements may be constructed off-site.

A panel element 70 has:

- a substrate 71, with longitudinal rectangular apertures 72 to receive dovetail sockets 5 or 7,
- hybrid apertures 73 with a wide portion to receive a dovetail socket and an orthogonal narrow portion to receive a bracing tongue of a rail,
- transverse slots 74, also to receive rail bracing tongues.

Left and right side rails 80 and 85 have the same features as the rails 20 and additionally have through holes 83 for services.

The soleplate 60 has the apertures 61 and 62 as described above. A stud 1 and a retainer 50 are also as described above.

Figure 10:
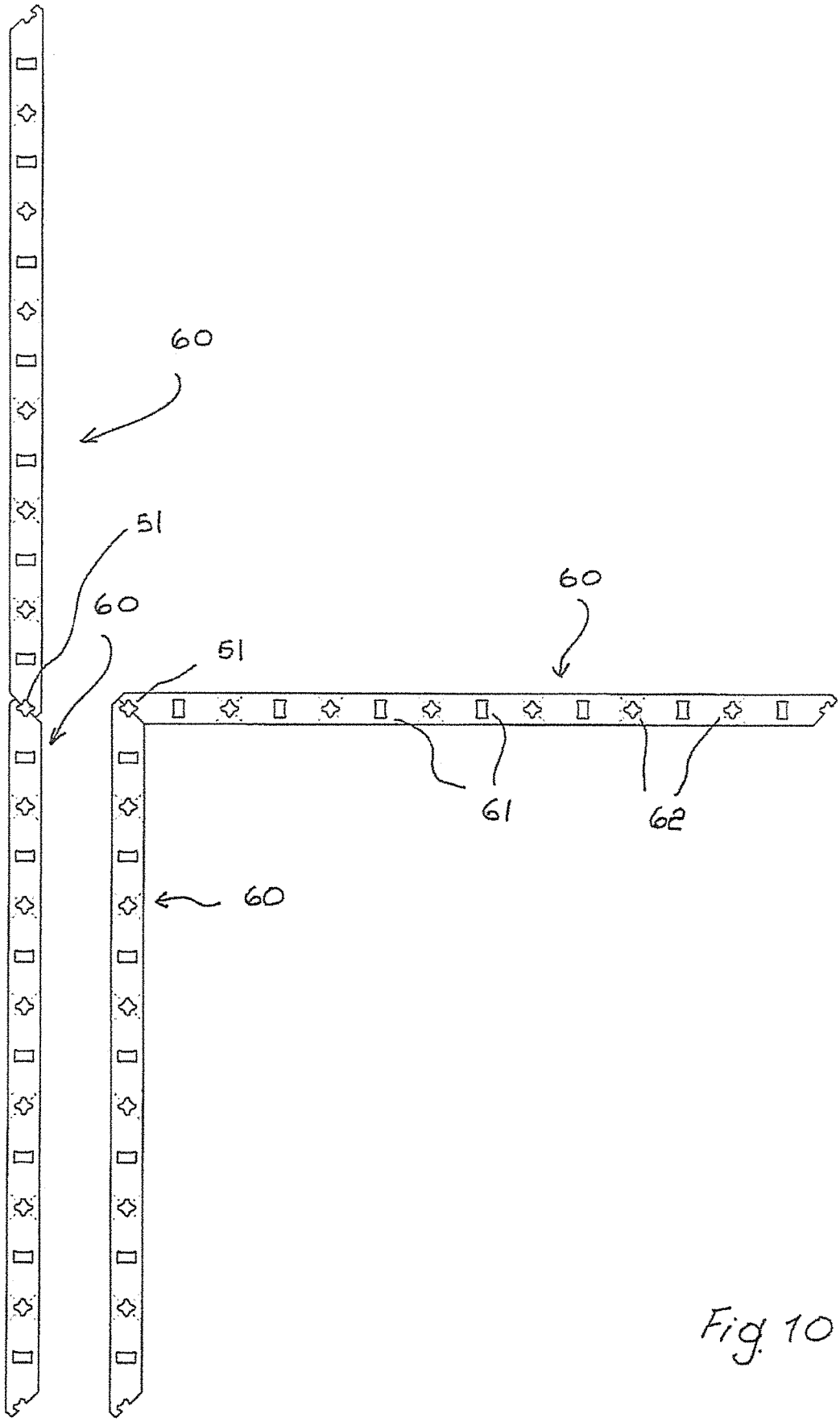
FIG. 10 is a plan view showing soleplate components interconnected at right angles and in-line.
Figure 11:
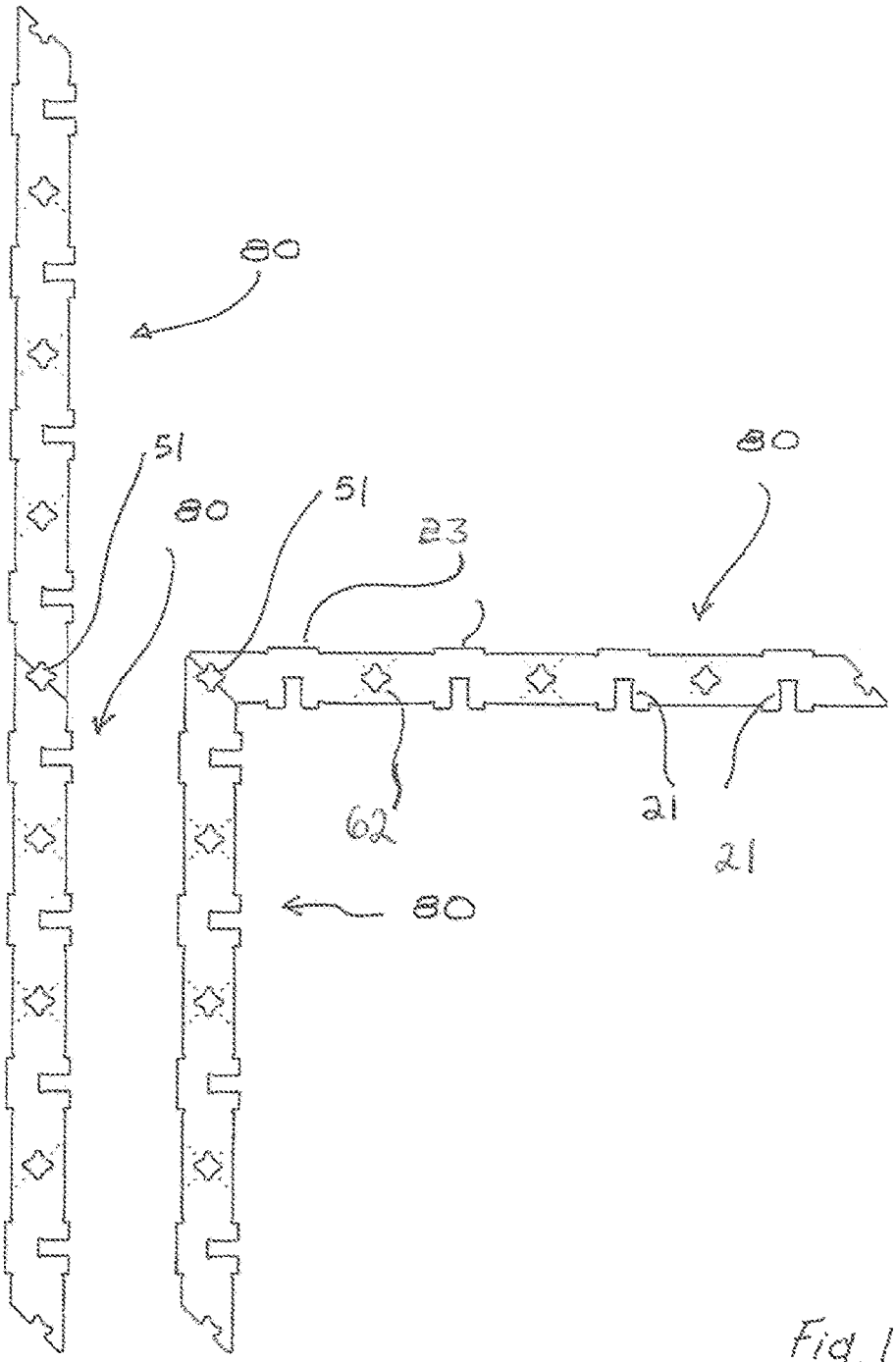
FIG. 11 is a plan view showing rails interconnected at right angles and in-line.

An insert 51 is suited to fit into a pair of half apertures when two lengths of soleplate meet at a joint, either at right angles or in-line, in both cases the cut being made at 45°. FIG. 10 shows the in-line and angled joints, both with an insert 51 strengthening the connection. Similar joints may be made with lengths of rail, as shown in FIG. 11. As is clear from FIGS. 10 and 11 the apertures 62 are in the form of two opposed dovetail sockets along a diagonal axis. Hence, when the stud 60 is cut at 45°, the studs are joined by the insert 51 acting as an integral pair of dovetails which engage in the two opposed dovetail sockets. This is very simple and convenient.

The header and sole plates 60 may be fabricated from GL28c glulam beams which are also milled through a CNC machine. The components clip together without the requirement for screws, nails or glue (apart from, in some cases, the sole and header plates) using the compression connection provided by the dovetail sockets 5 and 7 and the retainers 50. The system is based on a 555 mm grid but can be configured to any grid.

Figure 12:
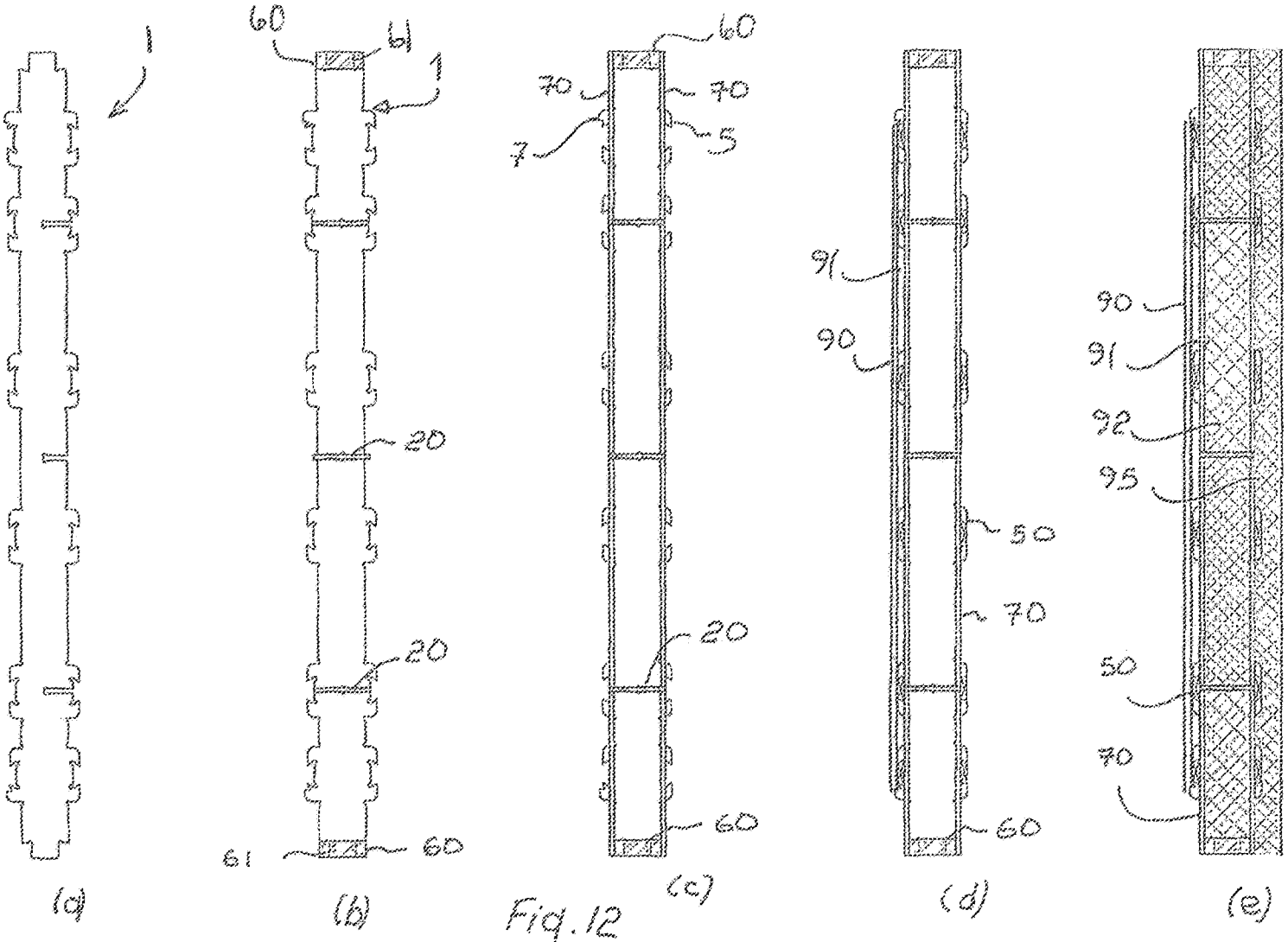
FIGS. 12(*a*) to 12(*e*) are diagrams showing progressive stages of wall construction, and FIGS. 13(*a*) to 13(*e*) show corresponding views at the stud-rail inter-connection.
Figure 13:
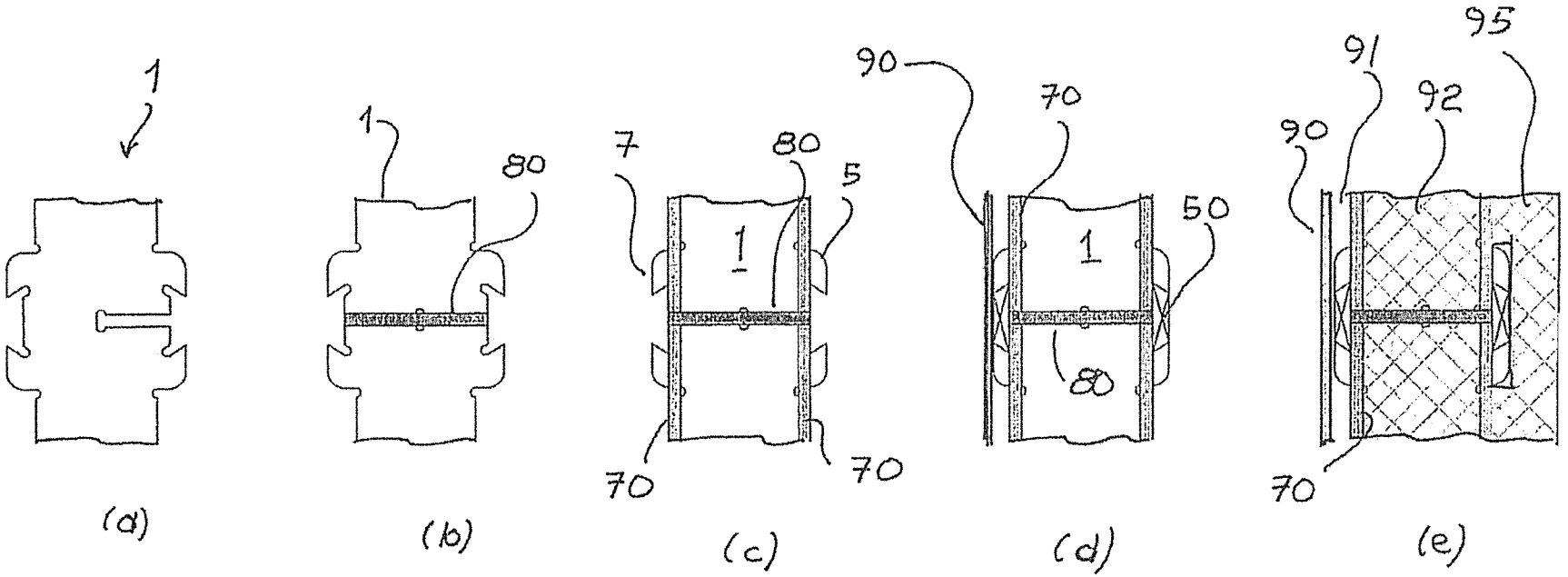

Referring to FIGS. 12 and 13 the sequence for wall construction is illustrated as follows:

(a) Provide studs 1.

(b) Insert ends of the studs into a sole plate 60 aperture 61 at both ground level and ceiling levels. In the top position it may be referred to as a wall plate.

(c) Press panels 70 towards the studs on both sides so that the dovetail sockets 5 and 7 extend through their apertures 72 and 73.

(d) Slide in the retainers 50 to complete compression joints with the dovetail sockets 5 and 7. The action of sliding in the retainers 50 involves a light hammer impact to a certain extent, as they are a tight fit so that they press in against the external surface of the panel. This completes the structural part of the wall section, the combination of the studs and rails together with the pressed-in panels 70 forming a tight structure with excellent tensile strength. In studies we have found that the load resistance to failure (excessive buckling) per stud 1 is:

Single ply stud: 50 kN,

Double ply stud: 65 kN, and

Triple ply stud, as illustrated, 75 kN

Of course, a panel element with two studs has a load resistance of double these figures. A ground floor level with wall constructed with wall elements having two-ply studs can support up to three storeys for example.

(e) Fix plasterboard 90 to the surfaces of the retainers 50. This avoids the problem of nailing into end "grain" of composite wood, as the rails are driven into the retainers 50, across the wood grain. It is very simple to affix the outer panels to the wall by fastening to the exposed surfaces of the retainers 50, and this provides an insulating gap bridged only by the wood material of the retainers. Such affixing is sufficient because the outer panels 90 are not load-bearing.

(f) Insert polystyrene insulation blocks 92 and 95 inside and outside the structure. The insulation 92 may alternatively be inserted before step (c), when the spaces between the studs are more open and easily accessible.

It will be appreciated that the system provides low-cost construction requiring minimal expertise, having ease of installation and multiple construction applications. The system can be used for permanent on-site builds, prefabricated panels, pre-manufactured modular housing, as well as for emergency accommodation and shelters. Also, the components are very light-weight, have good insulation, and are cost-effective to manufacture. Advantageously, the compression joints in combination with the studs and the panels achieve a very high load resistance. In some instances sufficient load resistance is achieved with none or a small number of rails between the sole plate and the wall plate.

Figure 14A:
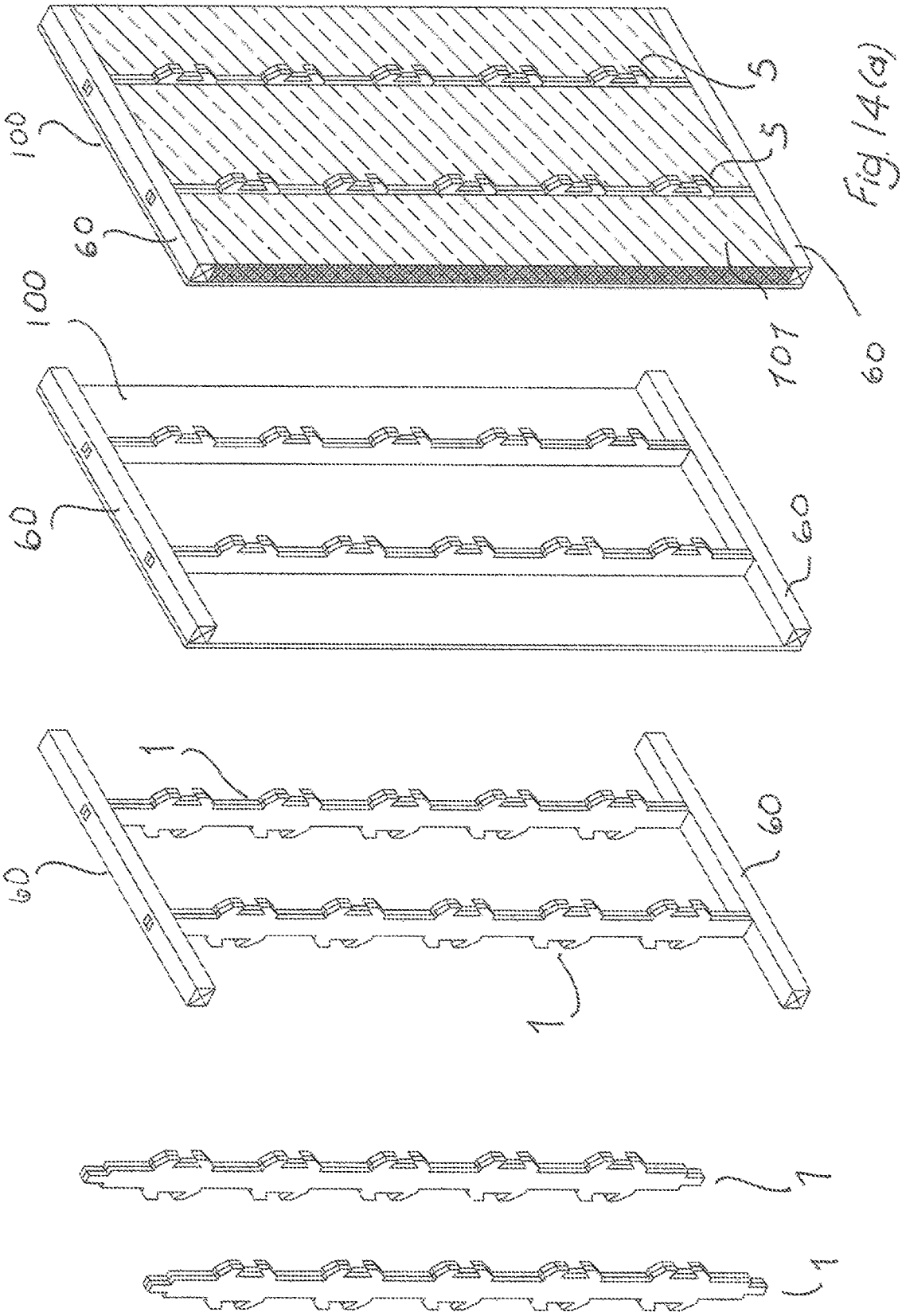
FIGS. 14(*a*) and 14(*b*) are together a series of perspective views showing stages of constructing a wall element according to another aspect.
Figure 14B:
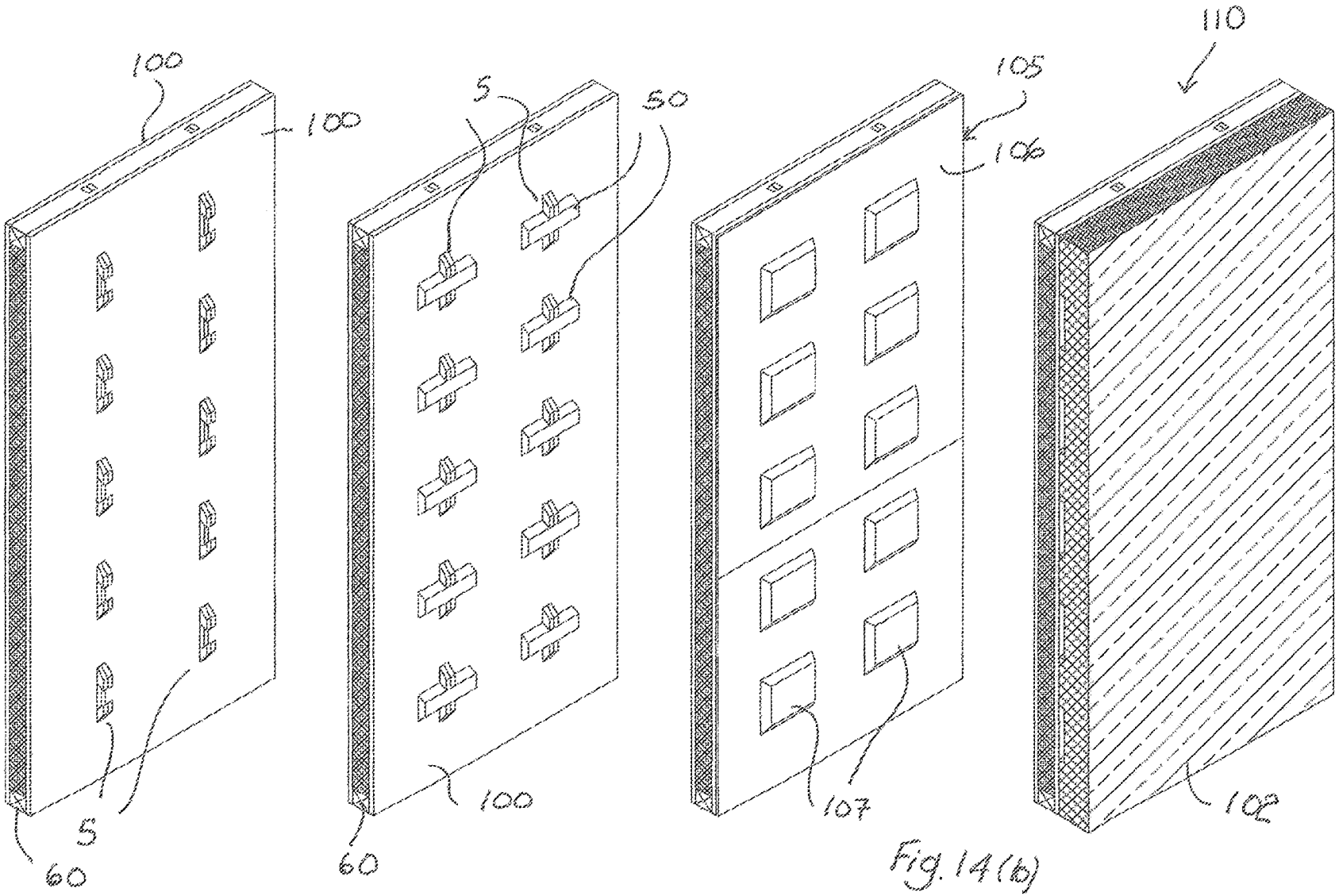

Referring to FIGS. 14(*a*) and (*b*) an alternative wall is constructed either on-site or off-site by providing studs 1, connecting them to sole plates 60 top and bottom as described, above, and then pressing a panel element 100 having openings only for the stud dovetail sockets 5. Insulation slabs 101 are inserted tightly into the gaps between the studs 1, and an opposed panel element 100 is pressed into place with the dovetail sockets 7 protruding. In this case there are no rails, the only horizontal members being the sole plates 60 top and bottom. The retainers 50 are then tapped into place within the dovetail sockets 5 to complete the compression joints in a regular pattern. A pre-formed membrane skin 105 having recesses 107 on a planar base 106 is applied to achieve sealing from moisture ingress from outside, and then external insulation slab 102 is applied. There may be other claddings applied as desired.

In this case the absence of rails reduces the number of parts and time of construction, and strength is still sufficient due to the fact that the panel elements 100 take the vertical loads in combination with the studs 1 and the compression joints 5, 50.

In a variation, there may be a small number of one or more rails 80 placed across the studs to contribute inter-connection of the studs additional to the sole plates and wall plates.

Figure 15:
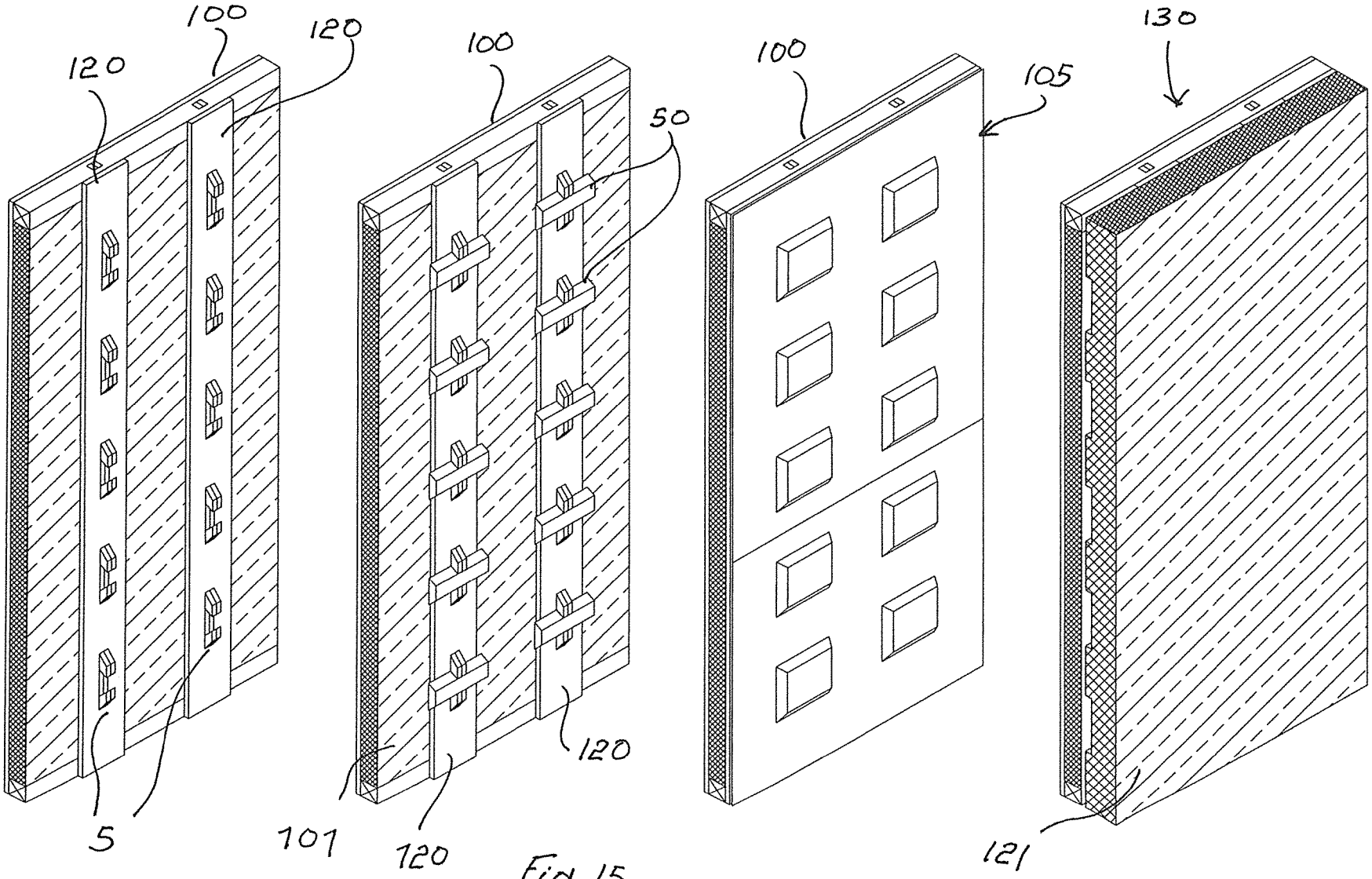
FIG. 15 shows a variation in which internal compression panels on one side of the wall are narrow and do not entirely cover the insulation, FIGS. 16(*a*) and (*b*) show a variation of the method of FIG. 15, in which the compression panels on both sides are narrow.

FIG. 15 shows a variation in which narrow panel elements 120 are used, taking the form of strips which do not cover the full surface of the wall element being constructed. External insulation 121 is applied on the outside, to provide a completed wall element 130. The panel elements 120 still perform the function of compression of the wall element and providing vertical structural strength, but there is less material required.

Figure 16A:
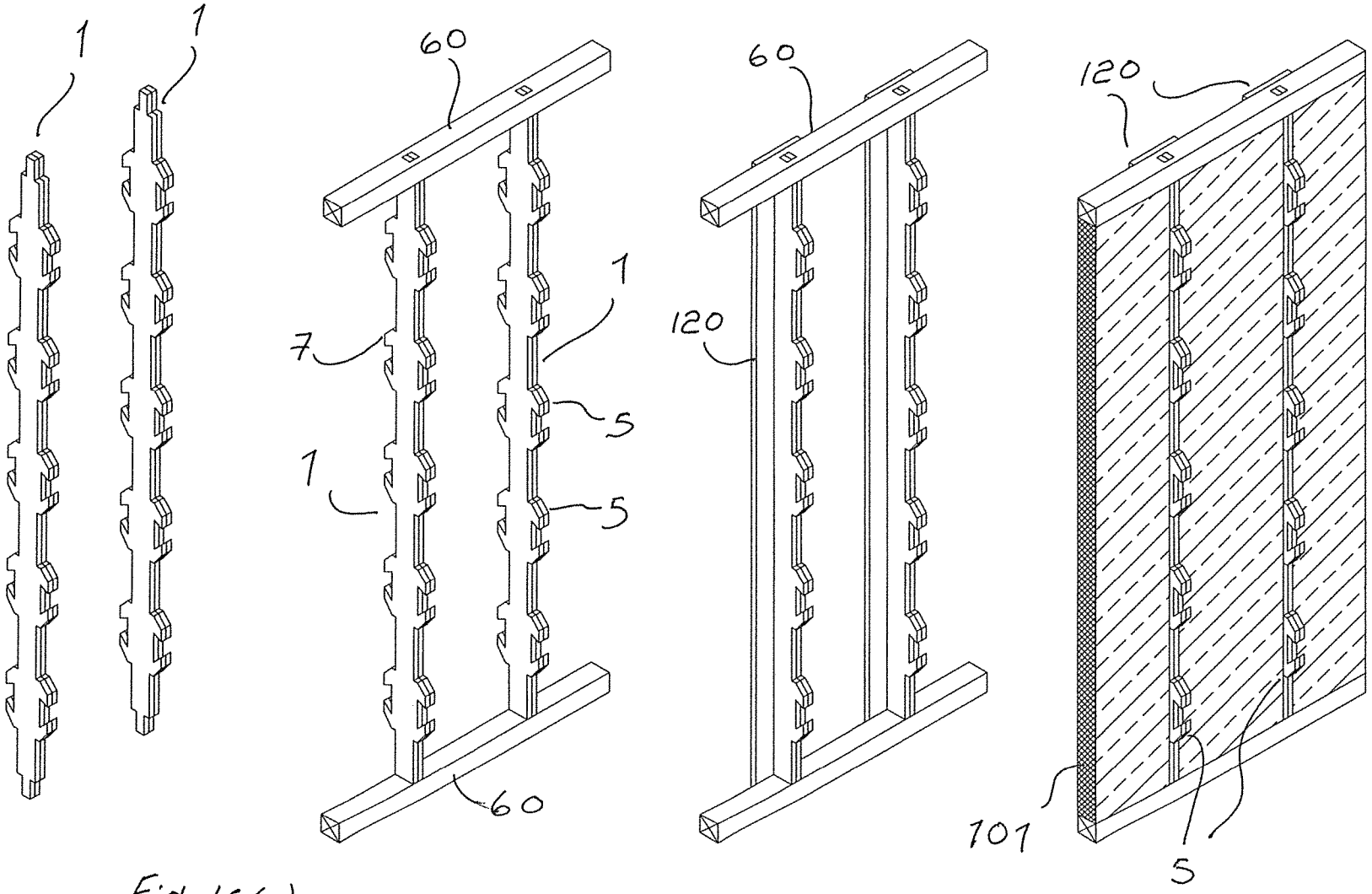
Figure 16B:
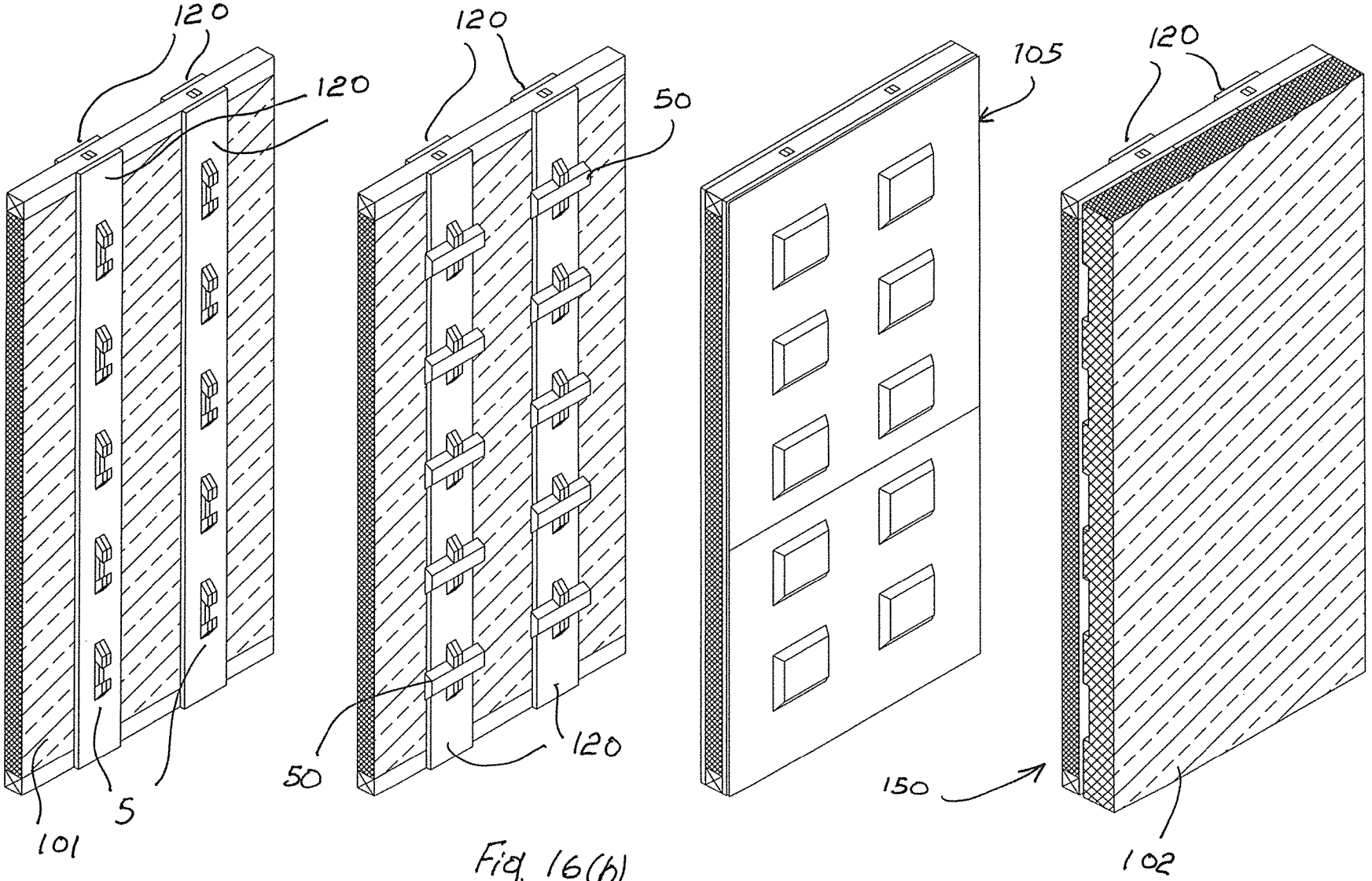

As shown in FIGS. 16(*a*) and (*b*) narrow panel elements 120 may be used on both opposed sides of the studs, applied in the same manner as for the full-width panel elements 70 and 100. The complete wall element is indicated by the numeral 150.

Figure 17:
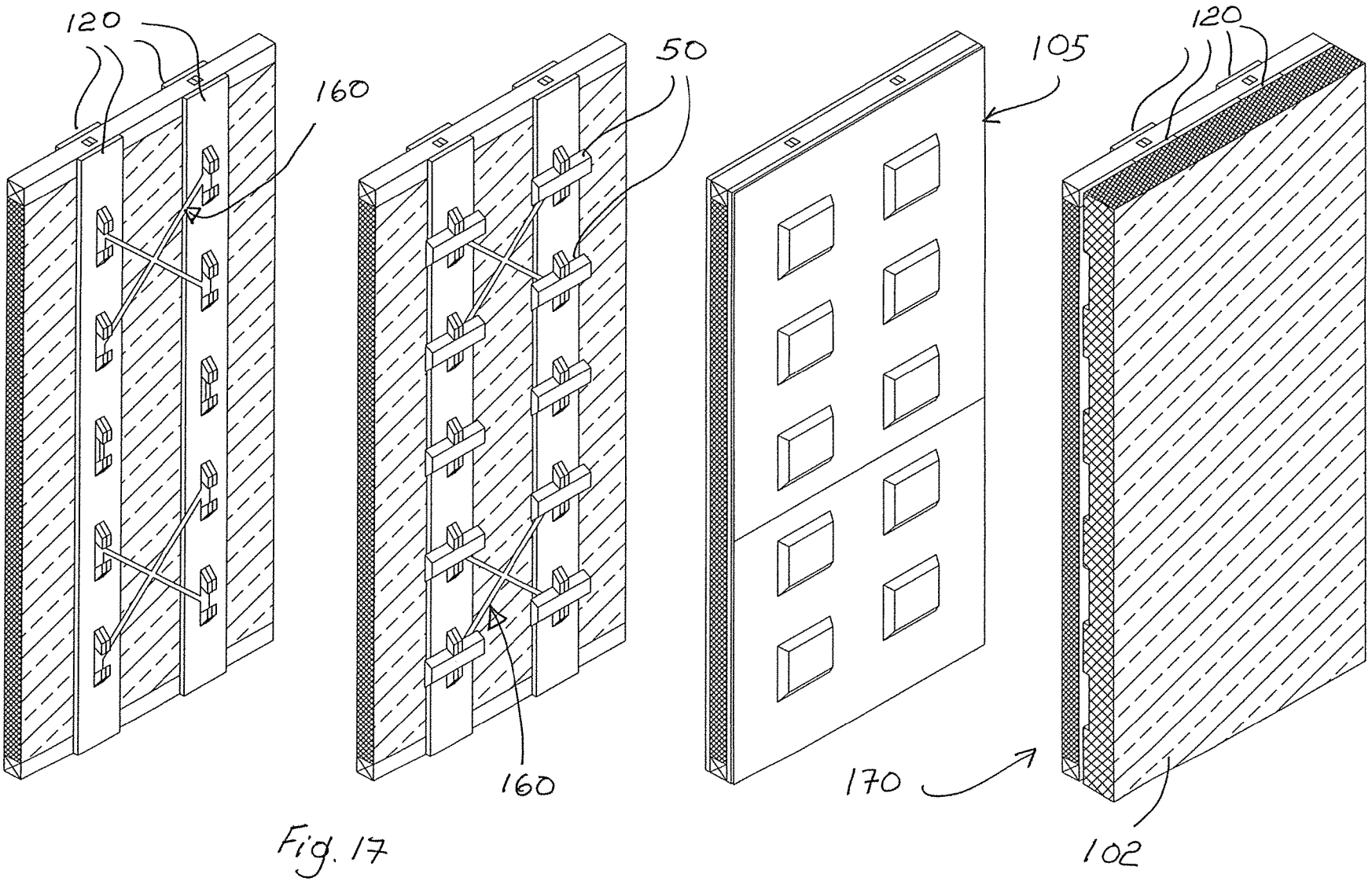
FIG. 17 shows cross-shaped braces being used to distribute compression forces from compression joints to the compression panels.

In another variation shown in FIG. 17, the retainers 50 on at least one side press against cross-shaped braces 160 which span two panel elements 140. Each compression joint therefore applies compressive forces both locally and across three other joints. This helps to ensure uniformity of compression, especially where the panel elements are narrow.

Figure 18:
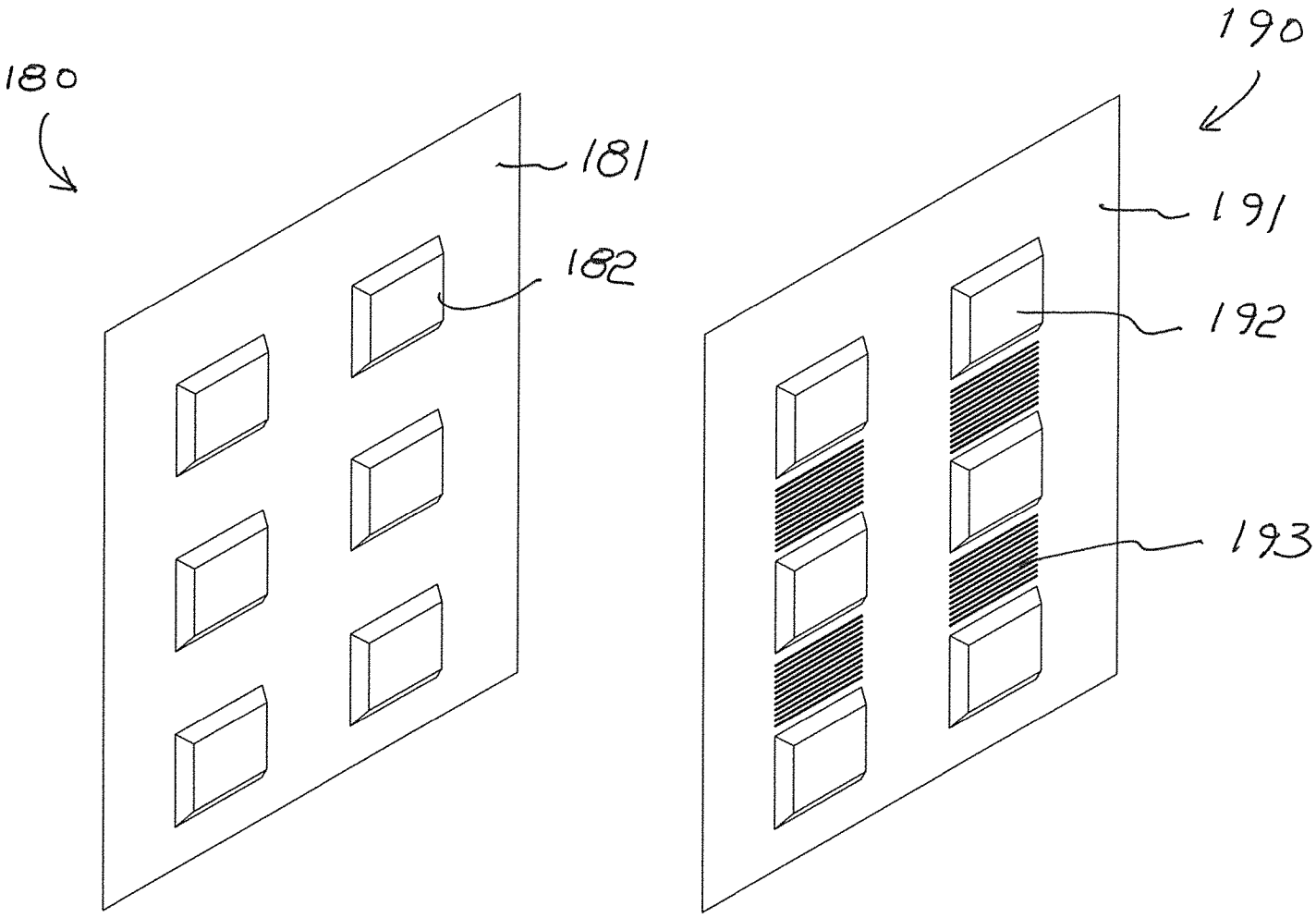
FIG. 18 is a pair of perspective views showing skins which may be applied within a wall for additional sealing from ingress of moisture from outside.

Referring to FIG. 18 alternative sealing skins 180 or 190 of thin aluminium foil material may be applied to the wall elements to provide a membrane to prevent ingress of moisture from outside. The skin 180 has a planar portion 181 and recesses 182 for accommodating the compression joints 50, 5. The skin 190 also a planar portion 191, recesses 192 for the same purpose, and louvres 193 to allow breathability for release of any moisture from inside while preventing ingress from outside. It is preferred that the skins have a thickness in the range of 0.2 to 0.5 mm, and they may include corrugations (not shown) to achieve sufficient rigidity for ease of handling. They may be of metal such as aluminium or of plastics material.

The membranes 180 and 190 are very easy to manipulate as they are rigid enough to be conveniently handled when being put in place and so avoid the problems on-site of handling sheets of light plastics material, which can be easily damaged and blown about if there is any wind.

Figure 19:
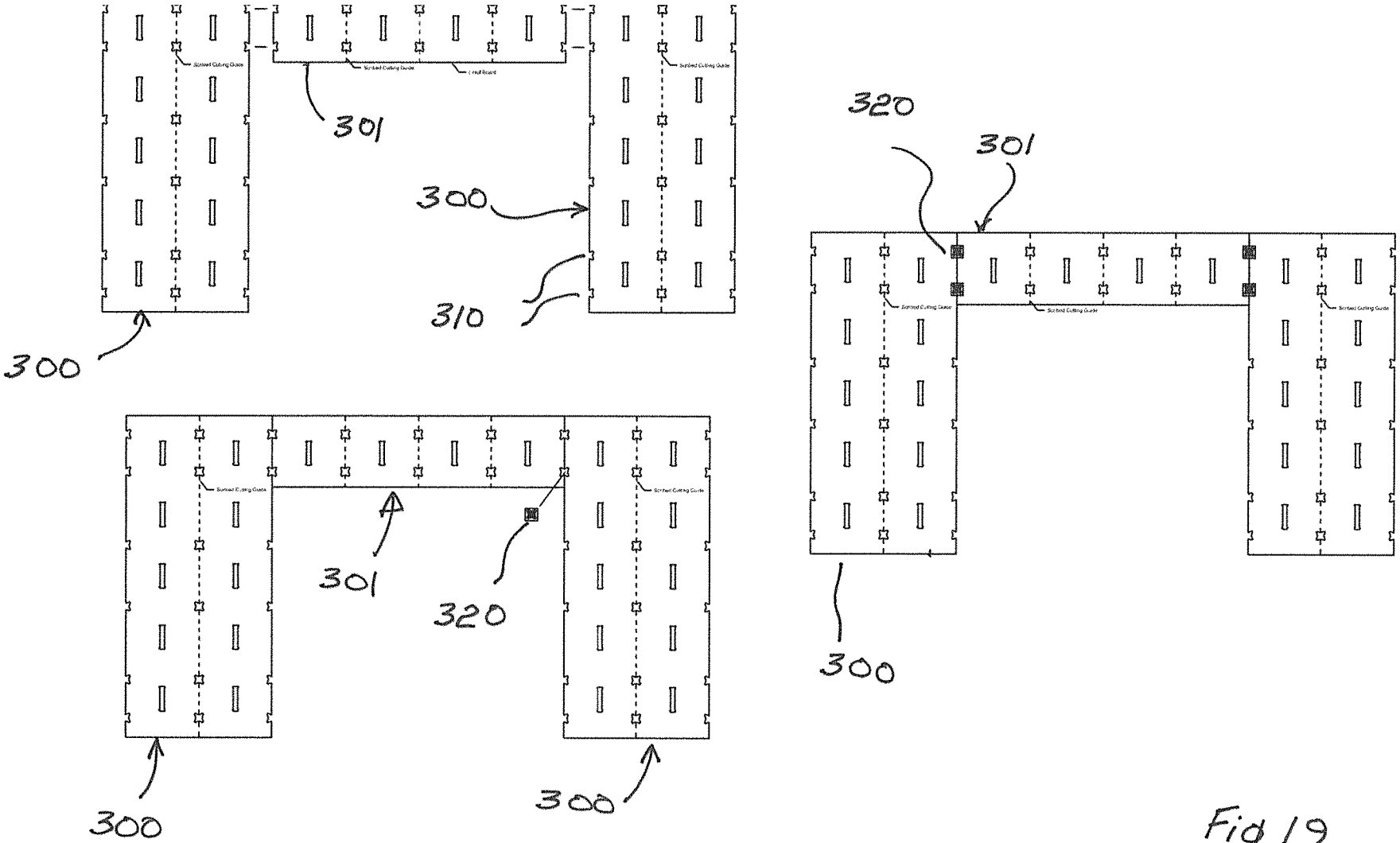
FIG. 19 is a set of front views of compression panel elements of other embodiments, which may be joined by stitching using bridging inserts, thereby effectively transferring loads between panel elements.
Figure 20:
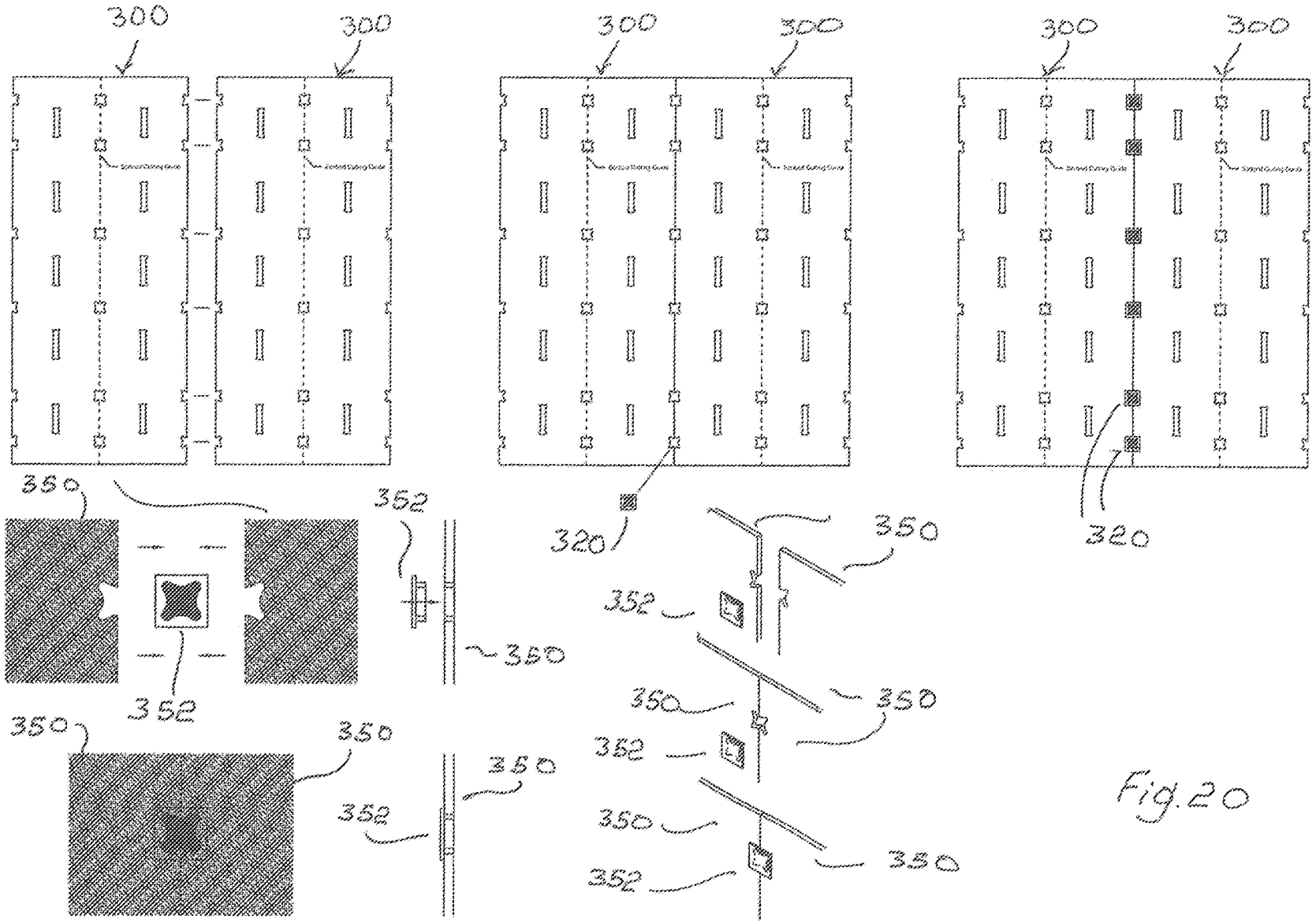
FIG. 20 is a set of front views of further compression panel elements joined using this stitching arrangement for load distribution across panel elements, and also various views of lintel compression panel elements joined in this manner.

Referring to FIG. 19 the panel elements may be adjoined by insertion of bridging members into apertures formed by two butted panel element edges, akin to the manner described above of adjoining sole plates and wall plates. This drawing shows panel elements 300 and 301, each having edge recesses 310 which mate together to form a full aperture when two panel elements are butted together. These apertures each have a star-shape, so that when a bridging piece 320 is inserted it forms a lock by engaging behind panel edge surfaces facing at least partly away from the main edge. This arrangement is shown more clearly in FIG. 20, which shows it for both main wall panels 300 and for lintel panels 350. As is shown more clearly in these drawings, the bridging member 352 is in the form of a pair of integral dovetails fitting into opposed dovetail slots 351.

Figure 21:
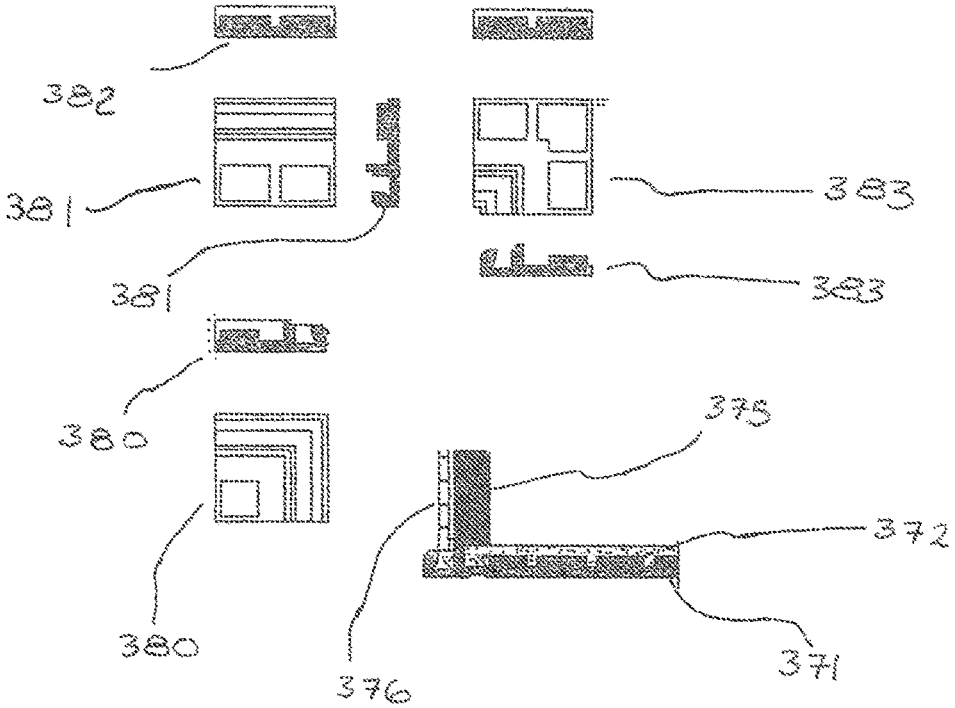
FIG. 21 is a set of plan and associated cross-sectional views showing manufacture of a floor and mounting of a wall on the floor.
Figure 21:
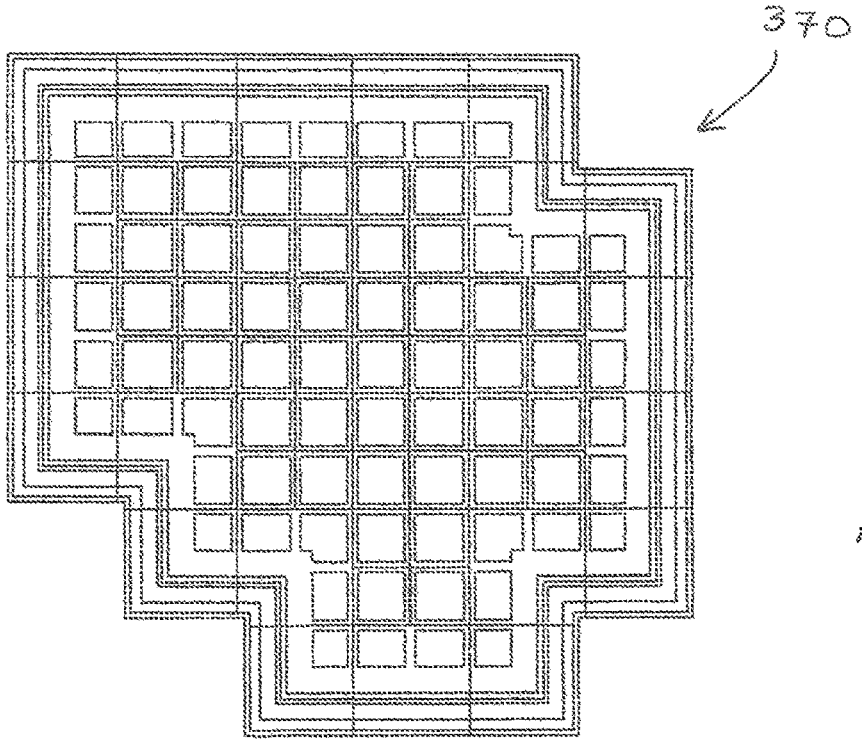

Referring to FIG. 21, a floor 370 may be constructed using blocks of foam with pre-set configuration of grooves. These are a variety of foam blocks, 371, 380, 383, 381, and 382. The foam blocks are arranged to form a floor with a desired shape, such as illustrated at 370. Concrete is then poured over the assembled foam blocks. A wall 375 constructed as described above is mounted on the floor, and there may be an external masonry leaf 376. This provides a pre-made foundation slab which by default meets the requirements of a raft foundation. The concrete sections also provide excellent acoustic, fire and thermal insulation between floors.

Figure 22:
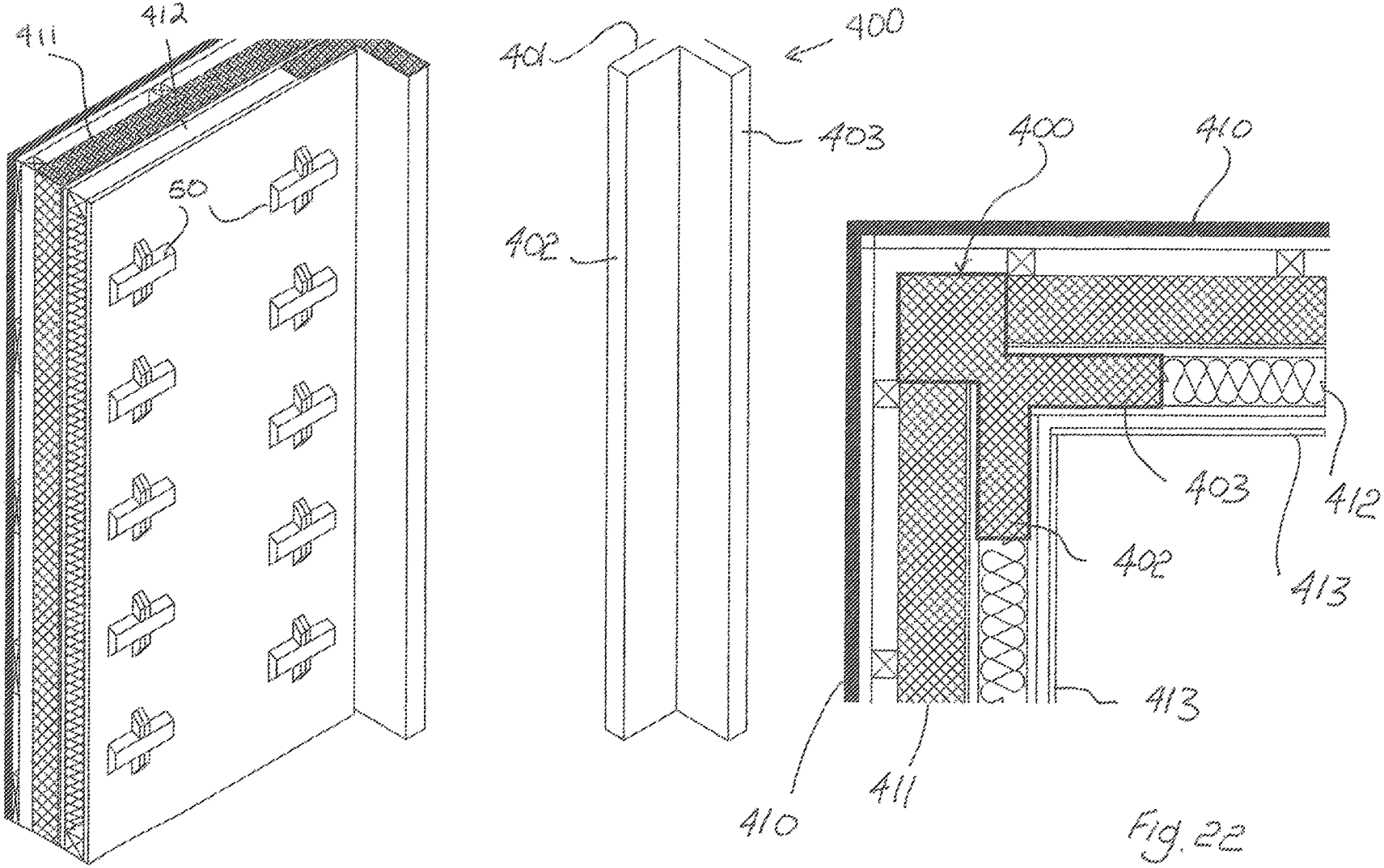
FIG. 22 is a perspective view of a corner piece and of a wall element joined with a corner piece, and a plan cross-sectional view showing the corner piece in place adjoining two walls.

Referring to FIG. 22 a building may have a corner member 400 inserted to form a corner at two adjoining walls. The corner member 400 comprises a main body 401 forming the external part of the corner, and mutually orthogonal tongues 402 and 403 which are aligned with and butt against structural wall portions 415 formed by the studs as shown above. In this example, the walls are completed by an external insulation panel 411 and an external wall finish layer 410, and on the internal side by a services gap formed by plasterboard 413 secured to the structural wall 412.

Figure 23:
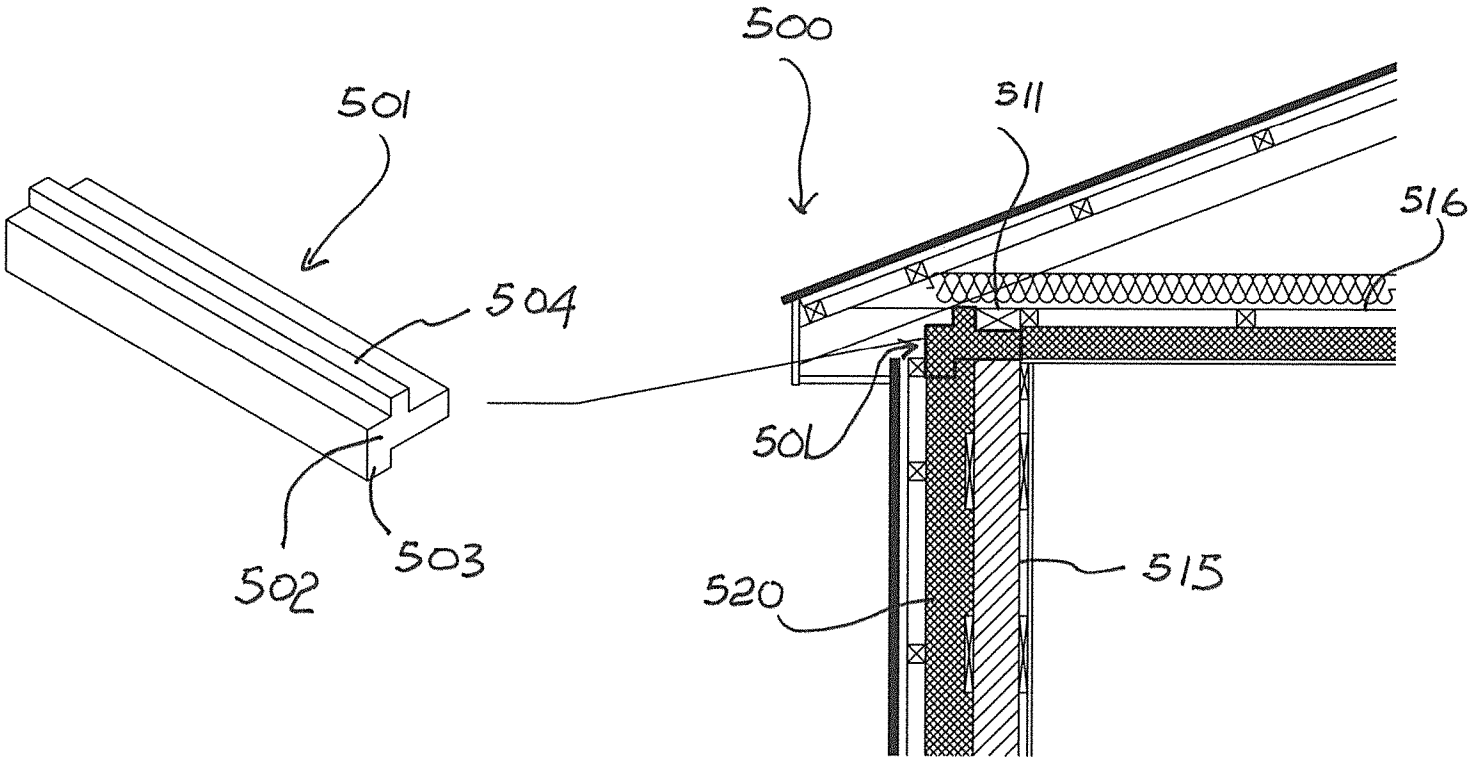
FIGS. 23, 24 and 25 are each a perspective and a cross-sectional view showing a wall/roof detail of other embodiments, in which there is improved sealing at the corner between a wall and a roof, near eaves.

Referring to FIG. 23 a roof may be mounted on walls by placing an eaves member on the wall and forming a joint between the eaves member and the roof structure. In FIG. 23 an eaves member 501 is mounted on a wall formed by a structural wall portion 515 and external insulation 520. The eaves member 501 comprises a main body 502 configured to fit on top of the wall, and a downwardly-depending lip 503 for extending downwardly into the external insulation of the wall. There is a top ridge 504 which has a height equivalent to a conventional wall plate 511.

The eaves member 501 is placed on the wall 515, 520 with the lip 503 extending downwardly into the insulation 520. The wall plate 511 is placed on the eaves member main body 502 alongside the ridge 504. Joists 516 rest on the eaves member 501 ridge 504 and the wall plate 511 and the remainder of the roof is conventional. This provides an excellent seal around the corner at the top of a wall and a roof, which traditionally has been a cold bridge.

Figure 24:
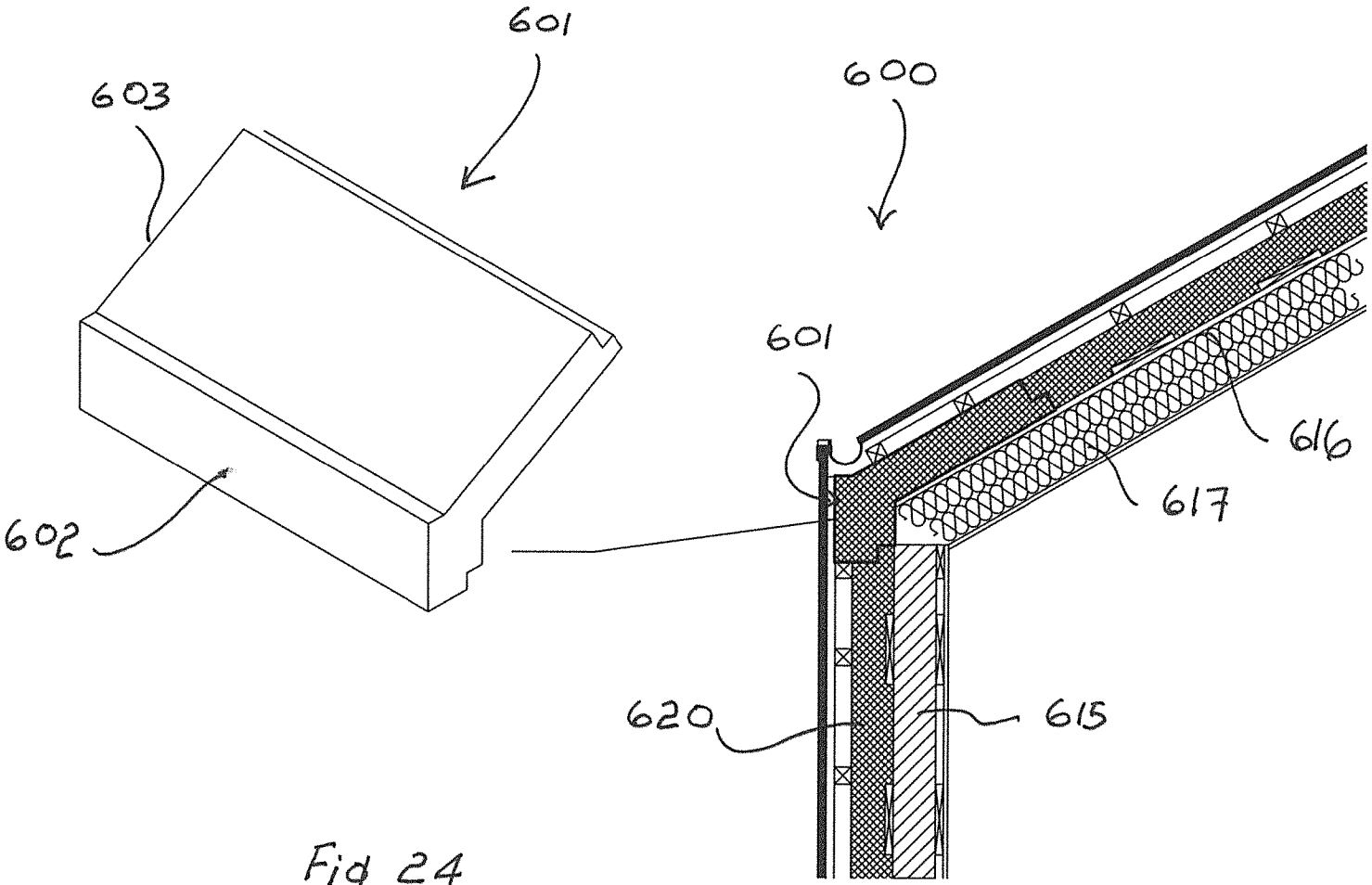

FIG. 24 shows a building 600 having an eaves member 601 having a wall-engaging portion engaging the outer part of the top surface of a wall formed by a structural wall 615 and external insulation 620, and a vaulted roof portion which extends at the angle of the roof to butt against roof panels 610 made of the same technique as the wall panels 110. The roof panels are formed using the studs and possibly also cross-rails as described above for the structural walls of any embodiment. As is clear in this view, there is a complete seal around the corner. The eaves member 601 has a downwardly-depending portion 602 for engaging the top of the wall, and an upper sloped portion 603 which is co-planar with the roof panels 610. In this case the eaves member is not load-bearing, but forms a very effective seal across the wall and roof, preventing a common thermal bridging location and hence improving overall insulation characteristics of the building.

Figure 25:
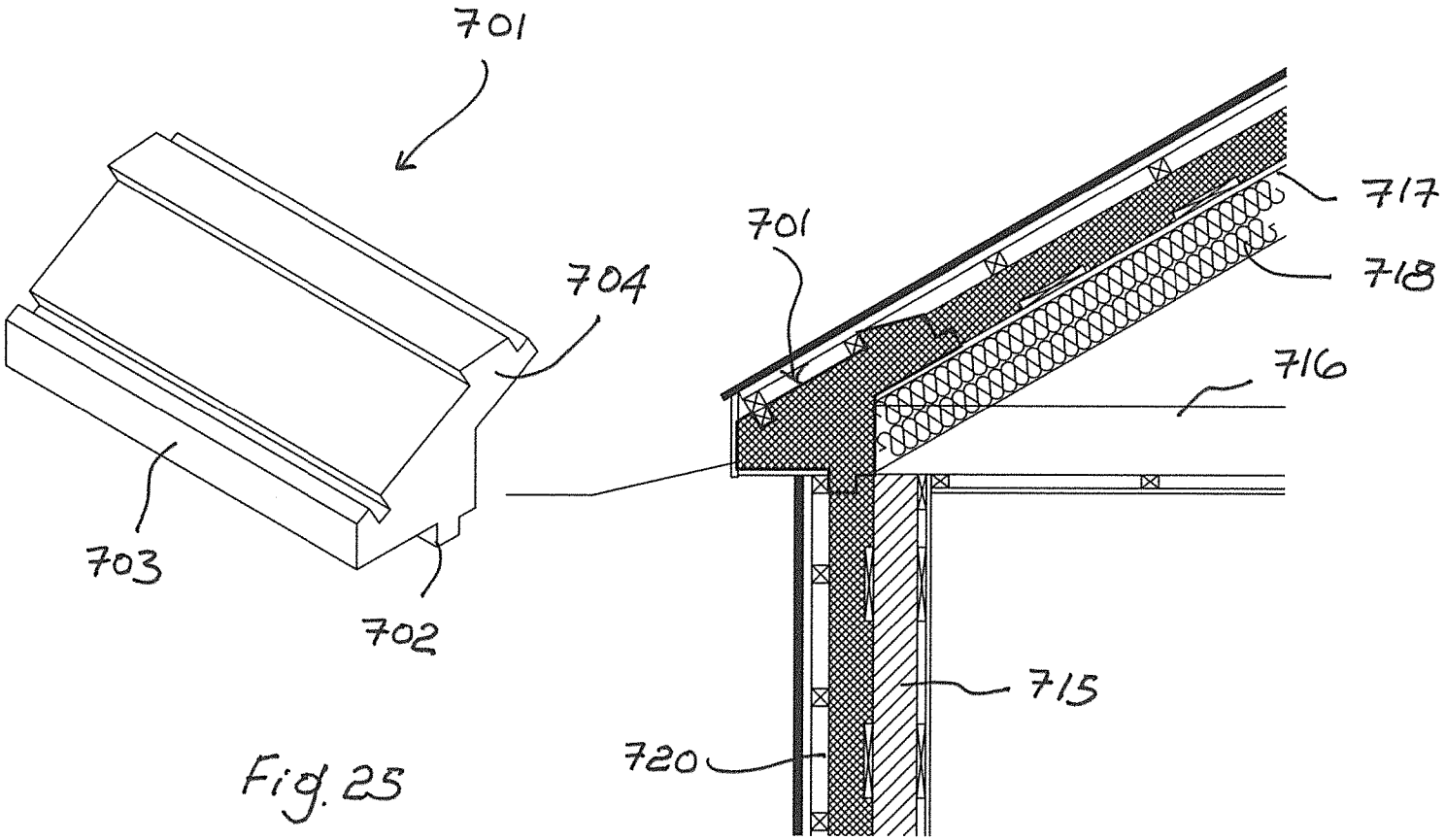

Referring to FIG. 25 an eaves member 701 rests on the wall directly at a wall top surface beyond the ends of the joists 716. Hence, the joists are terminated on the wall, and do not protrude beyond it, as would be conventional. The eaves member extends upwardly over part of the wall and at an angle of the roof to butt roof members, such as a roof structural panel formed by the studs and optionally also the rails as described above. This forms an envelope for improved insulation around the tops of the walls and, like the eaves member 601, is not load-bearing.

The eaves member 701 has a wall-engaging portion 702 in the form of a downwardly-depending ridge (engaging wall structural part 715 and external insulation 720), a roof-engaging portion 704 as for FIG. 24, but also a forwardly-projecting portion 703 to form a traditional eaves configuration. The joists 716 rest on only a portion of the wall, and are part of roof frames also including structural panels 717 and insulation 718. Like the eaves member 601, the eaves member 701 is not load-bearing.

It is envisaged that the eaves member may have indents to accommodate the joists, and in this case the joists may rest on the wall to the wall full depth.

Also, any of the eaves members may be used with other wall and/or roof arrangements, such as conventional cavity walls of block for example.

It will be appreciated that the eaves members of the various embodiments provide a thermal break between a wall and a roof in a very effective and simple manner.

Major advantages of the invention include:

(a) Simplicity of assembly/construction to achieve wall elements of very high strength.

(b) Reduced extent of materials required.

(c) Fast and accurate assembly either on-site of off-site.

(d) Very high compressive strength provided by the compression joints applying compression forces across the width of the studs. This allows the panel elements to provide structural integrity in combination with the studs, either with or without cross-rails between the sole and wall plates.

In other embodiments, some or all of the structural walls don't have rails forming a mesh with the studs, as the panels secured to the studs provide sufficient bracing strength. It is envisaged that structural walls with rails may be used for some walls, especially deeper walls, and possibly roof panels alongside rafters, and possibly in the foundations. For the latter, it is envisaged that the studs and any rails present may be of a plastics material rather than wood.

In various embodiments, it is not essential that the panel engagement features comprise dovetail sockets. However, in general it is preferred that panel engagement feature comprises a portion extending distally from the stud edge and a portion extending laterally, and configured so that the retainer fits within a space bordered by said portions with a tight fit so that compression force is applied to the panel and stud. It is preferred that the studs stud comprises a series of a plurality of panel engagement features along at least one edge, and most preferably that there is a series of panel engagement features on both opposed sides.

The invention is not limited to the embodiments described but may be varied in construction and detail.

The invention claimed is:

1. A construction system for a wall or floor or roof comprising:

a set of studs having side surfaces and edge surfaces, at least one of said set of studs including panel engagement features protruding from an edge of the stud, panel elements having apertures to receive said engagement features so that the engagement features protrude through the panel element apertures, retainers configured for engaging said panel engagement features when they protrude through said apertures and for pressing against an outside surface of a panel element and towards the studs with a compression force to form a compression joint pressing the panel element against the stud, a soleplate having apertures for receiving ends of the studs, a header plate having apertures to receive ends of the studs, and wherein the sole plate and/or the header plate have apertures and corresponding bridging inserts fitting said apertures, wherein a pair of soleplates or header plates butted at a cut through said aperture is joined by insertion of said insert across the cut line, wherein said apertures are shaped to form two opposed dovetail sockets, wherein:

at least one stud includes a series of a plurality of panel engagement features along at least one edge, at least one panel engagement feature includes a portion extending distally from the stud edge and a portion extending laterally, and configured so that the retainer fits within a space bordered by two of said engagement features with a tight fit so that said compression force is applied, and the retainer is in the form of a tongue configured for engagement with a friction fit with the panel engagement feature, and is wedge-shaped, with a narrower leading end.

2. The construction system as claimed in claim 1, wherein there is a series of panel engagement features on both opposed sides of at least one stud.

3. The construction system as claimed in claim 1, wherein at least one panel engagement feature comprises a portion extending distally from the stud edge and a portion extending laterally, and configured so that the retainer fits within a space bordered by said engagement features with a tight fit so that said compression force is applied; and wherein said space is in the form of a dovetail socket.

4. The construction system as claimed in claim 1, further comprising braces configured to interconnect a plurality of compression joints, wherein at least one brace includes a plurality of arms each configured to engage a compression joint.

5. The construction system as claimed in claim 1, further comprising outer sheets arranged to be fixed to the retainers to form a cavity defined by depth of the retainers.

6. The construction system as claimed in claim 1, wherein at least two panel elements are joined by bridging members each inserted into an aperture formed by opposing recesses on edges of adjoining panel elements to complete a panel, wherein said recesses have dovetail socket configurations, and wherein the panel elements each includes a series of a plurality of recesses for said joining.

7. The construction system as claimed in claim 1, wherein the studs have inter-engagement features on at least one side edge and the system includes a set of rails having corresponding inter-engagement features for engaging the stud features to form an inter-meshed grid.

8. The construction system as claimed in claim 1, wherein the studs have inter-engagement features on at least one side edge and the system includes a set of rails having corresponding inter-engagement features for engaging the stud features to form an inter-meshed grid, and wherein at least some rails include bracing tongues and the panel element has slots to receive said bracing tongues.

9. The construction system as claimed in claim 1, further comprising a waterproof skin arranged to fit over a panel, the skin having sufficient rigidity to maintain shape of recesses to accommodate the compression joints.

10. The construction system as claimed in claim 1, further comprising an elongate corner member configured to extend vertically to form a corner at adjoining walls, the corner member including a vertical corner portion having a configuration to form a corner and orthogonal tongues extending from the corner portion for butting against two walls, wherein the tongues extend from a single corner of the corner portion.

11. The construction system as claimed in claim 1, further comprising an elongate eaves member configured to extend along a joint between a wall and a roof, the eaves member including a downwardly-depending portion configured to engage a wall and an upper portion configured to engage a roof, and wherein the upper portion is configured to provide space for a wall plate to rest on the eaves member so that joists can rest on both the wall plate and the eaves member upper portion.

12. The construction system as claimed in claim 1, further comprising an elongate eaves member configured to extend along a joint between a wall and a roof, the eaves member including a downwardly-depending portion configured to engage a wall and an upper portion configured to engage a roof, and wherein the upper portion is configured to provide space for a wall plate to rest on the eaves member so that joists can rest on both the wall plate and the eaves member upper portion; and wherein the eaves member is configured to abut ends of joists resting on a wall and terminating over the wall, and wherein the eaves member upper portion extends at an angle of a roof pitch to engage the roof.

13. A construction method performed with a construction system comprising:

a set of studs having side surfaces and edge surfaces, at least one of said set of studs comprising panel engagement features protruding from an edge of the stud, panel elements having apertures to receive said engagement features so that the engagement features protrude through the panel element apertures, and retainers configured for engaging said panel engagement features when they protrude through said apertures and for pressing against an outside surface of a panel element and towards the studs with a compression force to form a compression joint pressing the panel element against the stud, wherein:

at least one stud comprises a series of a plurality of panel engagement features along at least one edge, at least one panel engagement feature comprises a portion extending distally from the stud edge and a portion extending laterally, and configured so that the retainer fits within a space bordered by two of said engagement features with a tight fit so that said compression force is applied, and, and in which the retainer is in the form of a tongue configured for engagement with a friction fit with the panel engagement feature, and is wedge-shaped, with a narrower leading end, the method comprising fabricating a structural wall section by:

aligning the studs parallel to each other, applying a panel element so that the engagement features protrude through the panel apertures, and engaging the retainers with the panel engagement features with a friction fit so that they press against an outside surface of the panel and towards the studs with a compression force to form a compression joint.

14. The construction method as claimed in claim 13, further comprising a step of mounting at least one brace to a plurality of retainers so that the brace links a plurality of compression joints.

15. The construction method as claimed in claim 13, comprising further steps of:

engaging ends of the studs in apertures of a sole plate and a wall plate, connecting at least two panel elements alongside edges of said panel elements by inserting bridging inserts into opposed sockets along the panel element edges, applying an outer sheet by fixing the sheet to said retainers so that there is a gap between the sheet and the panel elements set by depth of the retainers.

16. The construction method as claimed in claim 13, comprising further steps of:

engaging ends of the studs in apertures of a sole plate and a wall plate, connecting at least two panel elements alongside edges of said panel elements by inserting bridging inserts into opposed sockets along the panel element edges, applying an outer sheet by fixing the sheet to said retainers so that there is a gap between the sheet and the panel elements set by depth of the retainers; and comprising a further step of applying a waterproof membrane to an outside surface of a panel element, the membrane having recesses to accommodate the compression joints.

17. A construction system for a wall or floor or roof comprising:

a set of studs having side surfaces and edge surfaces, at least one of said set of studs including panel engagement features protruding from an edge of the stud, panel elements having apertures to receive said engagement features so that the engagement features protrude through the panel element apertures, and retainers configured for engaging said panel engagement features when they protrude through said apertures and for pressing against an outside surface of a panel element and towards the studs with a compression force to form a compression joint pressing the panel element against the stud, a soleplate having apertures for receiving ends of the studs, a header plate having apertures to receive ends of the studs, wherein the sole plate and/or the header plate have apertures and corresponding bridging inserts fitting said apertures, wherein a pair of soleplates or header plates are butted at a cut through said aperture and are joined by insertion of said insert across the cut line, and wherein said apertures are shaped to form two opposed dovetail sockets.

18. A construction method performed with a construction system comprising:

a set of studs having side surfaces and edge surfaces, at least one of said set of studs including panel engagement features protruding from an edge of the stud, panel elements having apertures to receive said engagement features so that the engagement features protrude through the panel element apertures, and retainers configured for engaging said panel engagement features when they protrude through said apertures and for pressing against an outside surface of a panel element and towards the studs with a compression force to form a compression joint pressing the panel element against the stud, the method comprising fabricating a structural wall section by:

aligning the studs parallel to each other, applying a panel element so that the engagement features protrude through the panel apertures, and engaging the retainers with the panel engagement features with a friction fit so that they press against an outside surface of the panel and towards the studs with a compression force to form a compression joint, engaging ends of the studs in apertures of a sole plate and a wall plate, connecting at least two panel elements alongside edges of said panel elements by inserting bridging inserts into opposed sockets along the panel element edges, and applying an outer sheet by fixing the sheet to said retainers so that there is a gap between the sheet and the panel elements set by depth of the retainers.

* * * * *